US005137796A

United States Patent [19]

Takiguchi et al.

[11] Patent Number: 5,137,796

[45] Date of Patent: Aug. 11, 1992

[54] MAGNETIC DEVELOPER, COMPRISING SPHERICAL PARTICLES MAGNETIC

[75] Inventors: Tsuyoshi Takiguchi, Yokohama; Tetsuya Kuribayashi, Tokyo; Koichi Tomiyama, Kawasaki; Tsutomu Kukimoto, Tokyo; Hiroshi Yusa, Yokohama; Eiichi Imai, Narashino, all of Japan

[73] Assignee: Canon Kabushiki Kaisha, Tokyo, Japan

[21] Appl. No.: 514,513

[22] Filed: Apr. 25, 1990

[30] Foreign Application Priority Data

Apr. 26, 1989 [JP] Japan ..... 1-106601
Apr. 27, 1989 [JP] Japan ..... 1-111003

[51] Int. Cl.[5] ..... G03G 9/14

[52] U.S. Cl. ..... 430/106.6; 430/109; 430/111; 430/137; 430/903

[58] Field of Search ..... 430/109, 137, 106.6, 430/903, 111

[56] References Cited

U.S. PATENT DOCUMENTS

| | | | |
|---|---|---|---|
| 3,942,979 | 3/1976 | Jones et al. | 96/1 SD |
| 3,969,251 | 7/1976 | Jones et al. | 252/62.1 P |
| 4,122,024 | 10/1978 | Jones et al. | 252/62.1 P |
| 4,284,701 | 8/1981 | Abbott et al. | 430/111 |
| 4,299,900 | 11/1981 | Mitsuhashi et al. | 430/122 |
| 4,554,234 | 11/1985 | Imai et al. | 430/122 |
| 4,592,987 | 6/1986 | Mitsuhashi et al. | 430/102 |
| 4,640,601 | 2/1987 | Deguchi et al. | 355/3 R |
| 4,816,365 | 3/1989 | Ishikawa | 430/111 |
| 4,824,752 | 4/1989 | Yasuda et al. | 430/106.6 |
| 4,935,325 | 6/1990 | Kuribayashi et al. | 430/106.6 |
| 4,939,060 | 7/1990 | Tomiyama et al. | 430/106.6 |
| 4,957,840 | 9/1990 | Sakashita et al. | 430/109 |

FOREIGN PATENT DOCUMENTS

| | | |
|---|---|---|
| 0207628 | 1/1987 | European Pat. Off. . |
| 57-66443 | 4/1982 | Japan . |
| 57-66455 | 4/1982 | Japan . |
| 58-178380 | 10/1983 | Japan . |
| 2114310 | 8/1983 | United Kingdom . |

OTHER PUBLICATIONS

Patent Abstracts of Japan, vol. 11, No. 12 (P-535) (2459) Jan. 13, 1987 & JP-A-61-188547.

*Primary Examiner*—Marion E. McCamish
*Assistant Examiner*—S. Rosasco
*Attorney, Agent, or Firm*—Fitzpatrick, Cella, Harper & Scinto

[57] ABSTRACT

A magnetic developer for developing an electrostatic latent image, including hydrophobic silica fine powder and an insulating magnetic toner comprising at least a binder resin and a magnetic material comprising spherical magnetic particles; wherein 0.16 to 1.6 wt. parts of the hydrophobic silica fine powder is mixed with 100 wt. parts of the insulating magnetic toner; the developer contains 17-60% by number of magnetic toner particles having a particles size of 5 microns of smaller, 5-50% by number of magnetic toner particles having a particle size of 6.35-10.08 microns, and 2.0% by volume or less of magnetic toner particles having a particle size of 12.7 microns or larger.

12 Claims, 10 Drawing Sheets

MAGNETIC DEVELOPER, COMPRISING SPHERICAL PARTICLES MAGNETIC

FIELD OF THE INVENTION AND RELATED ART

The present invention relates to a developer comprising at least hydrophobic silica fine powder and a magnetic toner containing spherical magnetic particles, and an image forming method and an image forming apparatus using the magnetic toner. The developer, image forming method and apparatus according to the present invention may suitably be used in an electrophotographic image forming method in order to develop a digital latent image comprising unit pixels represented by ON-OFF, or a finite gradation by a reversal development system.

Generally, in the electrophotographic system, an original image is exposed to light and the resultant reflected light is supplied to a latent image-carrying member to obtain a latent image thereon. In this system, because the light reflected from the original image is used for an image signal as such, the resultant latent image is an analog-type (hereinafter, referred to as "analog latent image") wherein the potential is continuously changed.

On the other hand, there has recently been commercialized a system wherein light reflected from an original image is converted into an electric signal which is then processed, and thereafter exposure is effected according to the processed signal. This system has various advantages such that image enlargement or power reduction of a higher magnification is effected easier than in the system using the analog latent image, and the image signal can be fed into a computer and output in combination with other information. However, if the analog image signal is handled as such, the signal content becomes enormous. Accordingly, the above-mentioned system requires digital processing wherein an image is divided into pixel units (hereinafter, each pixel may be referred to as "dot"), and exposure quantities are determined with respect to the respective pixels.

In a case where a latent image is digitized, it is necessary to develop each dot more precisely than previously using the conventional analog latent image. Accordingly, there is required a developer which is capable of developing respective pixels precisely or faithfully. Further, when a digital latent image is formed, it generally provides a deviation in surface potential which is larger than that in an analog latent image. Therefore, when the digital latent image is developed, it is necessary to develop portions of the latent image wherein the potential difference between a developer-carrying member and a latent image-bearing member such as a photosensitive drum is relatively small. Such development is particularly important in an image having a repetitive pattern of alternating image and non-image dots.

Accordingly, when a developer intended for developing an analog latent image is applied to a system using a digital latent image, dots are insufficiently developed, particularly in the case of the above-mentioned repetitive image pattern comprising alternating image and non-image dots. As a result, there occurs a phenomenon such that some dots provide reduced or no developed images, whereby the resultant image density is decreased or a letter image is blurred, as a whole. Such a phenomenon is quite noticeable when the developer comprises a toner containing magnetic material (hereinafter, referred to as "magnetic developer") which is liable to provide a relatively small amount of triboelectric charge. The reason for this may be considered that in the magnetic developer, the magnetic material protrudes from some surface portions of the toner particles, and so the surface area capable of contributing to the triboelectrification is decreased. Since the amount of the magnetic material protruding from the toner particle surfaces varies depending on the amount of the magnetic material contained in each magnetic toner particle, the distribution of triboelectric charge (amount) becomes broader than that in another type of developer. As a result, when the conventional magnetic developer is used in a system using a digital latent image, blurring of a letter image is liable to occur since developer particles having a small amount of triboelectric charge are accumulated in a developing apparatus. Accordingly, an improvement has been desired from such a viewpoint.

Recently, as image forming apparatus such as electrophotographic copying machines have widely been used, their uses have also extended in various ways, and higher image quality has been demanded. For example, when original images such as those in general documents are copied, it is demanded that even minute letters are reproduced extremely finely and faithfully without thickening or deformation, or interruption. However, in ordinary image forming apparatus such as copying machines for plain paper, when the latent image formed on a photosensitive member thereof comprises thin-line images having a width of 100 microns or below, the reproducibility in thin lines is generally poor and the clearness of line images is still insufficient.

Particularly, in recent image forming apparatus such as electrophotographic printer using digital image signals, the resultant latent picture is formed by a gathering of dots with a constant potential, and the solid, half-tone and highlight portions of the picture can be expressed by varying densities of dots. However, in a state where the dots are not faithfully covered with toner particles and the toner particles protrude from the dots, there arises a problem that a gradational characteristic of a toner image corresponding to the dot density ratio of the black portion to the white portion in the digital latent image cannot be obtained. Further, when the resolution is intended to be enhanced by decreasing the dot size so as to enhance the image quality, the reproducibility becomes poorer with respect to the latent image comprising minute dots, whereby there tends to occur an image without sharpness having a low resolution and a poor gradational characteristic.

On the other hand, in image forming apparatus such as electrophotographic copying machine, there sometimes occurs a phenomenon such that good image quality is obtained in an initial stage but it deteriorates as the copying or print-out operation is successively conducted. The reason for such phenomenon may be considered that only toner particles which are more contributable to the developing operation are consumed in advance as the copying or print-out operation is successively conducted, and toner particles having a poor developing characteristic accumulate and remain in the developing device of the image forming apparatus.

Hitherto, there have been proposed some developers for the purpose of enhancing the image quality. For example, Japanese Laid-Open Patent Application (JP-A, KOKAI) No. 3244/1976 (corresponding to U.S. Pat. Nos. 3,942,979, 3,969,251 and 4,112,024) has proposed a non-magnetic toner wherein the particle size distribution is regulated so as to improve the image quality. This toner comprises relatively coarse particles and predominantly comprises toner particles having a particle size of 8–12 microns. However, according to our investigation, it is difficult for such a particle size to provide uniform and dense cover-up of the toner particles to a latent image. Further, the above-mentioned toner has a characteristic such that it contains 30% by number or less of particles of 5 microns or smaller and 5% by number or less of particles of 20 microns or larger, and therefore it has a broad particle size distribution which tends to decrease the uniformity in the resultant image. In order to form a clear image by using such relatively coarse toner particles having a broad particle size distribution, it is necessary that the gaps between the toner particles are filled by thickly superposing the toner particles thereby to enhance the apparent image density. As a result, there arises a problem that the toner consumption increases in order to obtain a prescribed image density.

Japanese Laid-Open Patent Application No. 72054/1979 (corresponding to U.S. Pat. No. 4,284,701) has proposed a non-magnetic toner having a sharper particle size distribution than the above-mentioned toner. In this toner, particles having an intermediate weight has a relatively large particle size of 8.5–11.0 microns, and there is still room for improvement as a toner for a high resolution.

Japanese Laid-Open Patent Application No. 129437/1983 (corresponding to British Patent No. 2114310) has proposed a non-magnetic toner wherein the average particle size is 6–10 microns and the mode particle size is 5–8 microns. However, this toner only contains particles of 5 microns or less in a small amount of 15% by number or below, and it tends to form an image without sharpness.

Further, U.S. Pat. No. 4,299,900 has proposed a jumping developing method using a developer containing 10–50 wt. % of magnetic toner particles of 20–35 microns. In this method, the particle size distribution of the toner is improved in order to triboelectrically charge the magnetic toner, to form a uniform and thin toner layer on a sleeve (developer-carrying member), and to enhance the environmental resistance of the toner. However, in view of a further high demand for the thin-line reproducibility, resolution and adaptability to a reversal development system, there is room for further improvement.

On the other hand, Japanese Laid-Open Patent Application No. 66455/1982 has proposed a developing device for a one-component magnetic toner. This developing device, the toner-carrying member for carrying a magnetic toner on its surface comprises one of which surface has been subjected to a sandblasting treatment by using irregularly-shaped particles so as to provide an uneven rough surface having a specific unevenness state, and the toner can be constantly applied onto the toner-carrying member surface uniformly and evenly for a long period so as to provide a good toner coating state. The toner-carrying member is one having a surface such that the entire surface has numberless fine cuts or protrusions formed in random directions.

However, the developing device containing the toner-carrying member having the above-mentioned specific surface condition does not provide good results, when combined with the above-mentioned magnetic toner having a small particle size. In such a case, the toner or component constituting it adheres to the toner-carrying member surface to contaminate it, whereby a decrease in image density can occur in the initial image. Further, when the toner-carrying member surface is further contaminated due to successive use thereof, white dropouts are liable to occur in the resultant images regularly corresponding to the rotation period of the toner-carrying member. The reason for such a phenomenon may be considered that the toner component adheres to the slope of convexities and the concavities of the toner-carrying member surface and charging failure in the magnetic toner particles occurs, whereby the amount of charge in the resultant toner layer is decreased.

In general, a magnetic toner comprises components such as a binder resin, a magnetic material, a charge control agent, a release agent, etc. These materials are designed so as to prevent contamination of the surface of a toner-carrying member. Accordingly, the selection of the materials are severely restricted at present.

In order to prevent or reduce the contamination of the toner-carrying member for a magnetic toner, various methods have been proposed. For example, Japanese Laid-Open Patent Application Nos. 66443/1982 and 178380/1983 propose a toner-carrying member having a resin film with good releasability on its surface. These methods can prevent the contamination of the toner-carrying member. However, when such a toner-carrying member is used in combination with the above-mentioned toner having a small particle size, the triboelectric charge amount of the toner particles becomes too large and they tend to strongly adhere to the surface of the toner-carrying member such as sleeve. As a result, the toner particles are difficult to be subjected to development and the resultant image density is liable to be decreased.

As described hereinabove, it has been desired to stably provide toner images faithfully reproducing minute latent images.

SUMMARY OF THE INVENTION

An object of the present invention is to provide a magnetic developer which has solved the above-mentioned problems.

Another object of the present invention is to provide a magnetic developer which has an excellent thin-line reproducibility and gradational characteristic and is capable of providing a high image density.

A further object of the present invention is to provide a magnetic developer which shows little change in performances even when used in a long period.

A further object of the present invention is to provide a magnetic developer which shows little change in performances even when environmental conditions change.

A further object of the present invention is to provide a magnetic developer which shows an excellent transferability.

A further object of the present invention is to provide a magnetic developer which is capable of providing a high image density by using a small consumption thereof.

A further object of the present invention is to provide a magnetic developer capable of providing a large amount of triboelectric charge.

A further object of the present invention is to provide a magnetic developer which is excellent in resolution and reproducibility of a thin line, and which can suitably be used for developing a digital latent image.

A further object of the present invention is to provide a magnetic developer capable of forming toner images excellent in resolution, gradational characteristic and thin-line reproducibility, even when used in combination with an image forming apparatus wherein a latent image is formed by using a digital image signal and the latent image is developed by a reversal development system.

A further object of the present invention is to provide a magnetic developer which is less liable to damage a photosensitive member surface.

A further object of the present invention is to provide a magnetic developer which is less liable to be fused to a latent image-bearing member such as organic photoconductor drum.

A further object of the present invention is to provide an image forming method and an image forming apparatus which are capable of forming a uniform magnetic toner coating on a toner-carrying member and are capable of preventing or reducing the contamination of the toner-carrying member surface due to the magnetic toner and/or magnetic toner component during a long period, while using the above-mentioned developing method.

A further object of the present invention is to provide an image forming method and an image forming apparatus which are capable of providing clear toner image of high quality having excellent thin-line reproducibility and high image density without fog, during a long period.

A still further object of the present invention is to provide an image forming method and an image forming apparatus which show little change in performances even when used in a long period.

According to our investigation, it has been found that toner particles having a particle size of 5 microns or smaller have a primary function of clearly reproducing the contour of a latent image and of attaining close and precise cover-up of the toner to the entire latent image portion.

Particularly, in the case of an electrostatic latent image formed on a photosensitive member, the field intensity in the edge portion thereof as the contour is higher than that in the inner portion thereof because of the concentration of the electric lines of force, whereby the sharpness of the resultant image is determined by the quality of toner particles collected to this portion. According to our investigation, it has been found that the control of quantity and distribution state for toner particles of 5 microns or smaller is effective in solving the problem in image sharpness.

According to the present invention, there is provided a magnetic developer for developing an electrostatic latent image comprising:

hydrophobic silica fine powder and an insulating magnetic toner comprising at least a binder resin and a magnetic material; wherein 0.6 to 1.6 wt. parts of the hydrophobic silica fine powder is mixed with 100 wt. parts of the insulating magnetic toner;

the magnetic developer having a BET specific surface area of 1.8 to 3.5 $m^2/g$, a triboelectric chargeability of $-20$ to $-35$ $\mu C/g$, an aerated bulk density of 0.40 to 0.52 $g/cm^3$, and a true density of 1.45 to 1.8 $g/cm^3$;

the magnetic material having an average particle size of 0.1 to 0.35 micron and comprising 50% by number or more of spherical magnetic particles of which surfaces substantially comprise curved surfaces;

the insulating magnetic toner containing 70–120 wt. parts of spherical magnetic particles with respect to 100 wt. parts of the binder resin;

the developer containing 17–60% by number of magnetic toner particles having a particle size of 5 microns or smaller, containing 5–50% by number of magnetic toner particles having a particle size of 6.35–10.08 microns, and containing 2.0% by volume or less of magnetic toner particles having a particle size of 12.7 microns or larger; wherein the magnetic toner has a volume-average particle size of 6–8 microns, and the magnetic toner particles having a particle size of 5 microns or smaller has a particle size distribution satisfying the following formula:

$$N/V = -0.05N + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.6 to 6.7, and N denotes a positive number of 17 to 60.

The present invention also provides an image forming method, comprising:

disposing an electrostatic image-bearing member carrying thereon an electrostatic image, and a toner-carrying member carrying a magnetic toner on the surface thereof with a predetermined clearance therebetween, wherein the toner-carrying member has a surface covered with a film of a phenolic resin containing electroconductive carbon and graphite; and the magnetic toner comprises an insulating one-component magnetic toner comprising at least a binder resin and a magnetic material; and the magnetic toner has a triboelectric chargeability of $-20$ to $-35$ $\mu C/g$ and a volume-average particle size of 6–8 microns; the magnetic material comprising 50% by number or more of spherical magnetic particles of which surfaces substantially comprise curved surfaces; the toner containing 17–60% by number of magnetic toner particles having a particle size of 5 microns or smaller, containing 5–50% by number of magnetic toner particles having a particle size of 6.35–10.08 microns, and containing 2.0% by volume or less of magnetic toner particles having a particle size of 12.7 microns or larger; wherein the magnetic toner particles having a particle size of 5 microns or smaller has a particle size distribution satisfying the following formula:

$$N/V = -0.05N + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.6–6.7, and N denotes a positive number of 17–60;

conveying the magnetic toner to a developing position while regulating the toner so as to provide a thickness smaller than said clearance; and developing the electrostatic image formed on the image-bearing member in the developing position in the presence of an alternating electric field, thereby to form a toner image on the latent image-bearing member.

The present invention further provides an image forming apparatus comprising:

an electrostatic image-bearing member for carrying an electrostatic image;

a toner-carrying member for carrying a magnetic toner on the surface thereof;

means for disposing the electrostatic image-bearing member and the toner-carrying member so that they are disposed opposite to each other with a predetermined clearance therebetween; and a member for regulating the magnetic toner so as to provide a thickness thereof which is smaller than the clearance;

wherein the toner-carrying member has a surface covered with a film of a phenolic resin containing electroconductive carbon and graphite; and the magnetic toner comprises an insulating one-component magnetic toner comprising at least a binder resin and a magnetic material; and has a triboelectric chargeability of −20 to −35 μC/g and a volume-average particle size of 6–8 microns;

the magnetic material comprises 50% by number or more of spherical magnetic particles of which surfaces substantially comprise curved surfaces;

the toner contains 17–60% by number of magnetic toner particles having a particle size of 5 microns or smaller, contains 5–50% by number of magnetic toner particles having a particle size of 6.35–10.08 microns, and contains 2.0% by volume or less of magnetic toner particles having a particle size of 12.7 microns or larger; wherein the magnetic toner particles having a particle size of 5 microns or smaller has a particle size distribution satisfying the following formula:

$$N/V = -0.05N + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.6–6.7, and N denotes a positive number of 17–60.

The present invention further provides a facsimile comprising an image forming apparatus and receiving means for receiving image information from a remote terminal; the image forming apparatus comprising:

an electrostatic image-bearing member for carrying an electrostatic image;

a toner-carrying member for carrying a magnetic toner on the surface thereof;

means for disposing the electrostatic image-bearing member and the toner-carrying member so that they are disposed opposite to each other with a predetermined clearance therebetween; and a member for regulating the magnetic toner so as to provide a thickness thereof which is smaller than the clearance;

wherein the toner-carrying member has a surface covered with a film of a phenolic resin containing electroconductive carbon and graphite; and the magnetic toner comprises an insulating one-component magnetic toner comprises at least a binder resin and a magnetic material; and has a triboelectric chargeability of −20 to −35 μC/g and a volume-average particle size of 6–8 microns;

the magnetic material comprises 50% by number or more of spherical magnetic particles of which surfaces substantially comprise curved surfaces;

the toner contains 17–60% by number of magnetic toner particles having a particle size of 5 microns or smaller, contains 5–50% by number of magnetic toner particles having a particle size of 6.35–10.08 microns, and contains 2.0% by volume or less of magnetic toner particles having a particle size of 12.7 microns or larger; wherein the magnetic toner particles having a particle size of 5 microns or smaller has a particle size distribution satisfying the following formula:

$$N/V = -0.05N + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.6–6.7, and N denotes a positive number of 17–60.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
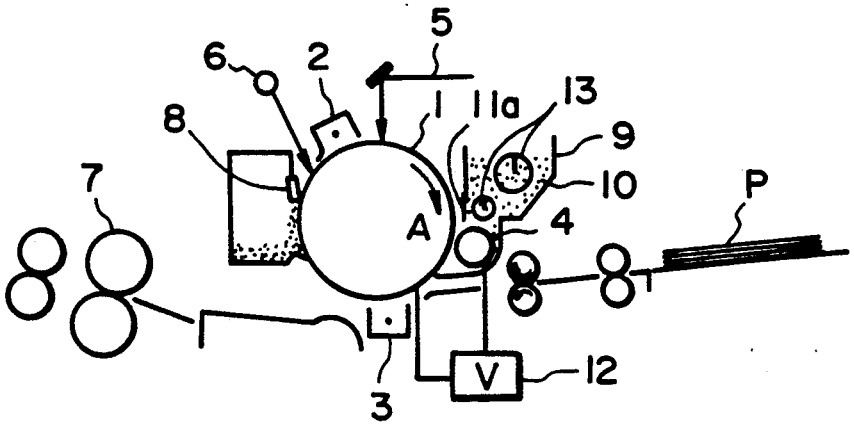
FIG. 1, 3 and 5 are schematic sectional views each showing an embodiment of the image forming apparatus to which the magnetic developer according to the present invention may suitably be applied.

The magnetic developer according to the present invention comprising hydrophobic silica fine powder and an insulating magnetic toner which comprises a predetermined amount of spherical magnetic particles and has the above-mentioned particle size distribution can faithfully reproduce thin lines in a latent image formed on a photosensitive member, and is excellent in reproduction of dot latent images such as halftone dot and digital images, whereby it provides images excellent in gradation and resolution characteristics. Further, the developer according to the present invention can retain a high image quality even in the case of successive copying or print-out, and can effect good development by using a smaller consumption thereof as compared with the conventional one-component type magnetic developer, even in the case of high-density images. As a result, the magnetic developer of the present invention is excellent in economical characteristics and further has an advantage in miniaturization of the main body of a copying machine or printer.

Particularly, the magnetic developer according to the present invention may preferably be used in an image forming method wherein a digital electrostatic latent image in the form of minute spots formed on an organic photoconductor having a negative chargeability is developed or visualized by a reversal development system, the resultant toner image is electrostatically transferred to a transfer material (or transfer-receiving material) such as plain paper and a sheet for an OHP (overhead projector), and then fixed onto the transfer material.

Respective components constituting the magnetic developer according to the present invention are described hereinbelow.

In order to narrow the triboelectric charge distribution in a developer, the magnetic material may, for example, be dispersed more uniformly in a binder resin. As a method used for such uniform dispersion, there has been known a method wherein a magnetic material is surface-treated with a treating agent such as titanium coupling agent to make a magnetic particle surface lipophilic. However, such a treating agent is expensive and the process for the surface treatment is complex, whereby the production cost is undesirably increased.

According to our investigation, it has been confirmed that the dispersibility of a magnetic material in a resin may further be improved by using spherical magnetic particles, as compared with conventional magnetic particles of cubic crystal system.

The spherical magnetic particles to be used in the present invention may preferably comprise 50% by number (more preferably 70% by number, particularly preferably 80% by number) of magnetic particles having a curved surface. The content of such magnetic particles may be determined in the following manner.

An enlarged photograph of a sample is taken by means of a scanning electron microscope (magnification =20,000 to 30,000) and 100 particles are randomly selected from the resultant photograph, and spherical magnetic particle content of the randomly selected particles is determined.

Even when ordinary magnetic particles of a cubic crystal system having a plane or flat surface and having a square or angular corner are contained in the spherical magnetic particles, the cubic magnetic particles content may preferably be lower than 50% by number, more preferably 20% by number or lower.

The spherical magnetic particles may preferably have an average particle size (primary particle size) of 0.1–0.35 micron. In the present invention, the average particle size of the spherical magnetic particles may determined in the following manner.

Figure 12:
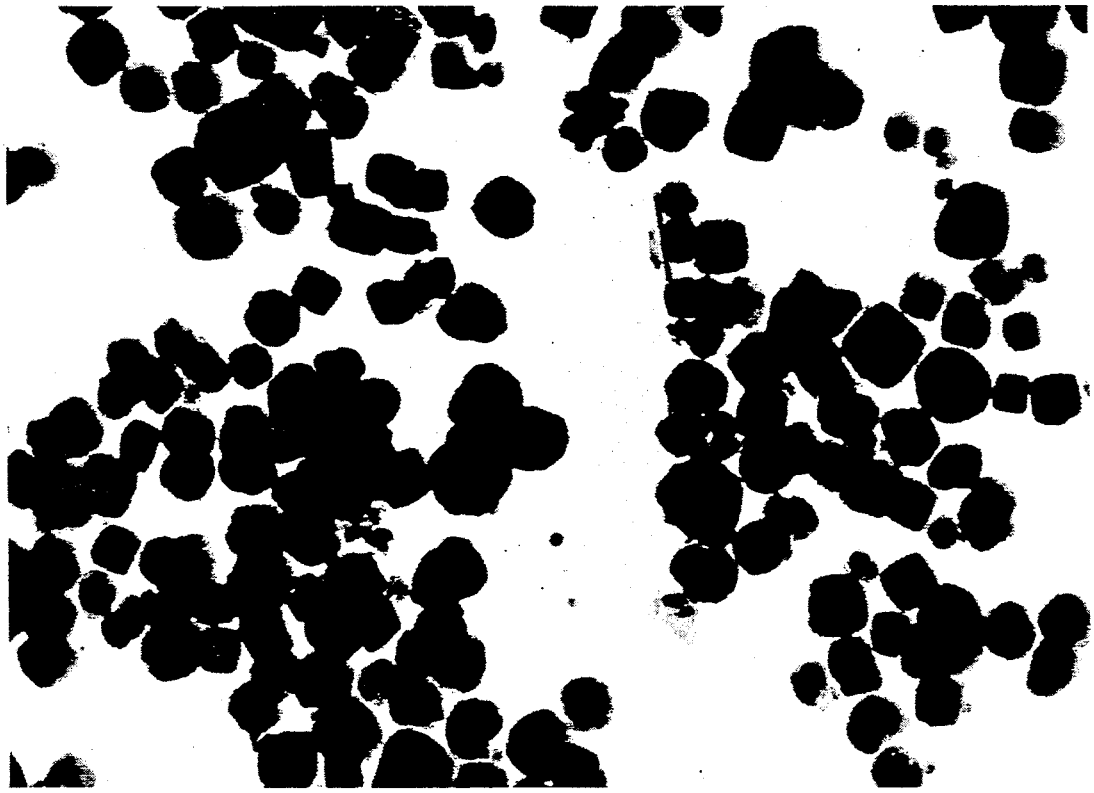
FIG. 12 is a photograph of spherical magnetic particles used in Example 1 (magnification: 30,000), which was formed by a scanning electron microscope (SEM).

An enlarged photograph of a sample is taken by means of a scanning electron microscope (magnification =20,000 to 30,000), and the longer axes of 100 to 200 particles randomly selected from the resultant photograph are measured and averaged. It is preferred that the spherical magnetic particles as shown in FIG. 12 to be used for the magnetic toner according to the present invention have a packed bulk density of 1.2–2.5 g/cm$^3$ (more preferably 1.5–2.0 g/cm$^3$), and have a linseed oil absorption of 5–30 ml/100 g (more preferably 10–25 ml/100 g, particularly preferably 12–17 ml/100 g).

In the present invention, the packed bulk density of the magnetic material may be measured by means of an instrument for measurement, Powder Tester (mfd. by Hosokawa Micron K.K.) and a container attached to the Powder Tester, according to the procedure described in the instruction manual for the above-mentioned Powder Tester.

More specifically, the packed bulk density may be measured in the following manner.

An attachment cap is added to a measurement cap for measuring apparent density, and then the cup is loaded in the tapping holder of the above-mentioned Powder Tester. Sample powder is charged in the cup gently and sufficiently up to the upper portion of the cap the upper portion of the cap is equipped by using an attachment scoop, and with an attachment cap cover in order to prevent the scattering of the sample powder disposed in the measurement cup.

The "vibration-tapping" changeover switch of the Powder Tester is adjusted to "TAP." for tapping. When a power supply for supplying an AC voltage of 50 Hz is used, the timer is adjusted to 216 sec. so that the number of the taps is 180.

The start push button is pushed so that the tapping operation starts. In the tapping operation, when the sample powder is compressed so that the upper level thereof is lowered to the upper portion of the measurement cup, the "vibration-tapping" changeover switch is adjusted to "OFF" so that the tapping operation pauses. The cap cover is once removed and the sample powder is further added to the measurement cup, and thereafter the tapping operation is continued until the number of the taps reaches 180.

After the tapping operation is completed, the measurement cup is taken out from the tapping holder, and the attachment cap and the cap cover is gently removed therefrom. Then, excess powder disposed over the top of the measurement cup is removed by an attachment blade. Thereafter, the sample powder is weighed accurately by an even balance.

As the inner volume of the cup for measurement is 100 cm$^3$, the packed bulk density (g/cm$^3$) (or tap density) of the sample powder is obtained as the sample weight (g)/100.

On the other hand, the linseed oil absorption of the magnetic material used in the present invention may be measured according to the method described in JIS K 5101-1978 (pigment testing method).

More specifically, the linseed oil absorption may be measured in the following manner.

1–5 g of a sample powder is disposed on a glass plate (about 250×250×5 mm), and boiled linseed oil is slowly dropped from a buret to the central portion of the sample powder, while sufficiently kneading the whole sample powder whenever a small portion of the linseed oil is dropped to the sample.

The above-mentioned operation of dropping and kneading are repeated until the whole sample is converted into a hard putty-like single mass for the first time, and the surface of the mass has gloss due to the linseed oil, i.e., the operation reaches the end point. The amount of the linseed oil used until the end point is measured, and the linseed oil absorption G (%) is calculated according to the following formula:

$$G = H/S \times 100$$

G: amount of the linseed oil (ml)

S: mass (or weight) of the sample (g)

Incidentally, some species of pigments cannot provide the above-mentioned surface gloss. Thus, when such pigment is used as the sample, the end point may be defined as a point immediately before one such that the sample is abruptly softened due to the one drop of the boiled linseed oil, and adheres to the glass plate.

Figure 13:
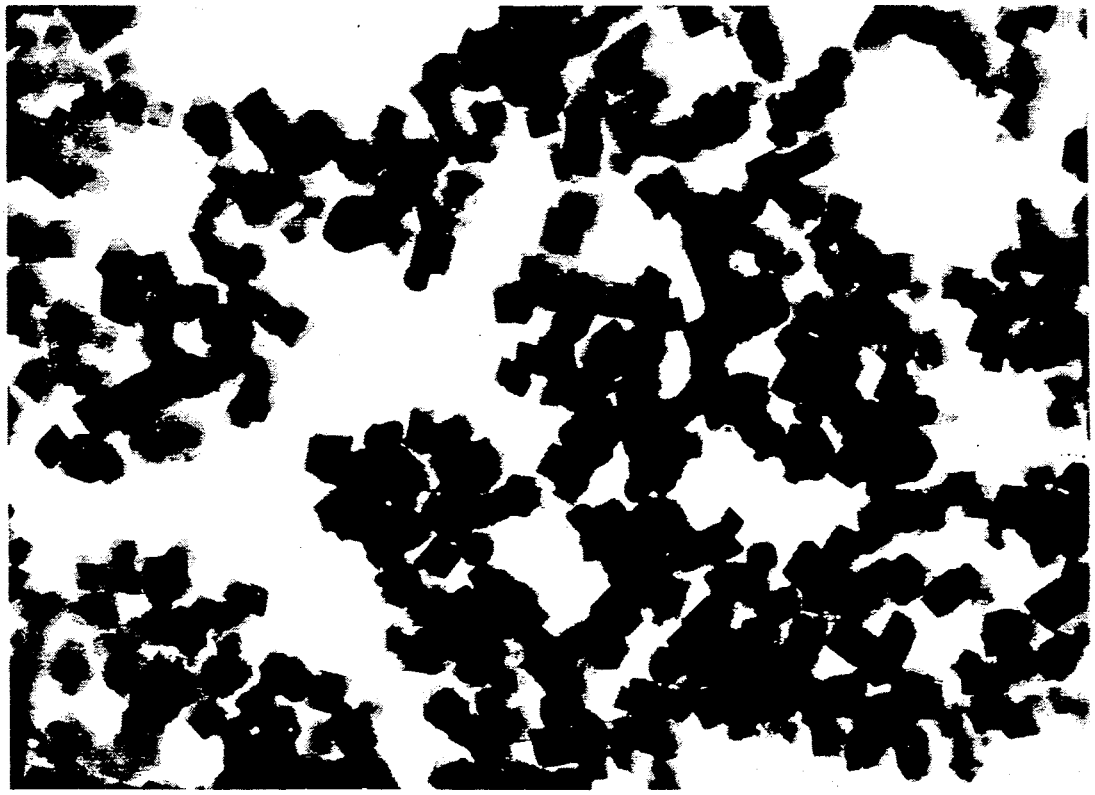
FIG. 13 is a photograph of magnetic particles in a cubic crystal form used in Comparative Example 1 (magnification: 30,000), which was formed by a scanning electron microscope.

The conventional magnetic material comprising magnetite particles in the cubic crystal system as shown in FIG. 13 shows a packed bulk density (or tap density) of below 0.6 g/cm$^3$, and ordinarily shows a packed bulk density in the range of 0.3–0.5 g/cm$^3$. On the other hand, the conventional magnetic material comprising spherical magnetite particles shows a packed bulk density of below 1.0 g/cm$^3$, and ordinarily shows a packed bulk density in the range of 0.7–0.9 g/cm$^3$.

Figure 10:
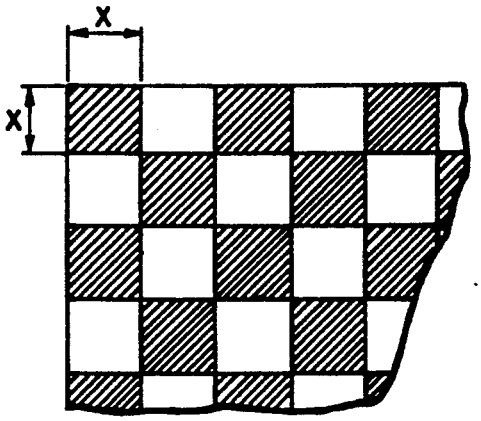
FIG. 10 is a partial view showing an image pattern used for the reproducibility test for dots in Examples and Comparative Examples.

In the toner obtained by using the conventional magnetic material of magnetite particles in a cubic crystal system, the dispersibility of the magnetic particles is insufficiently uniform in each toner particle or among toner particles. Accordingly, such toner provides blurred toner image in some cases when used for developing a digital latent image. According to our experiment, when a digital latent image formed from an original image having a checkered pattern as shown in FIG. 10 was developed with a magnetic toner comprising the conventional magnetic particles in a cubic crystal system, it was found that the black image portions were liable to partially drop out and the image forming characteristic of the toner such as resolution of the resultant image was insufficient.

Further, when a magnetic material composed of magnetite particles showing a cubic crystal is subjected to disintegration treatment to disintegrate the aggregate of the magnetite particles, the packed bulk density of the thus treated magnetic material becomes larger, and a magnetic toner containing the treated magnetic material shows an improved developing characteristic as compared with that of a magnetic toner containing untreated magnetic material. However, such an improvement is still insufficient.

Moreover, when particles such as cubic crystals having a flat portion therein are subjected to disintegration treatment, the flat surfaces of the particles are liable to closely contact each other and a higher energy is required to separate respective particles, as compared with in the case of contact with a curved surface. Further, the magnetic particles in a cubic crystal system have sharp edge portions which can easily be broken due to stress. Accordingly, when the aggregate of the magnetic material in the cubic crystal system is subjected to disintegration treatment, a considerable amount of fine powder is produced, whereby the characteristic of the treated magnetic material (such as BET specific surface area) is changed from the original target value.

On the other hand, ordinary spherical magnetite particles which are not subjected to disintegration treatment have an improved dispersibility in a binder resin as compared with that of the magnetic material in the cubic crystal system. The untreated spherical magnetic particles may further improve their packed bulk density and dispersibility in a resin when subjected to disintegration treatment.

In the present invention, spherical magnetic particles having a packed bulk density of 1.2–2.5 g/cm$^3$ may preferably be used. This value of the packed bulk density is large so that no ordinary untreated magnetic particles in a cubic crystal system, cubic crystal magnetic particles subjected to disintegration treatment, or untreated ordinary spherical magnetic particles can satisfy it.

The specific spherical magnetic particles used in the present invention may preferably be prepared by disintegrating spherical magnetic particles having a packed bulk density of not less than 0.7 g/cm$^3$ and less than 1.0 g/cm$^3$ and a linseed oil absorption of 10–35 ml/100 g.

In order to disintegrate the spherical magnetic particles, there may for example be used a mechanical pulverizer having a high-speed rotor for disintegrating powder, and a pressure-dispersing machine having a load-applying roller for dispersing or disintegrating powder.

In a case where the mechanical pulverizer is used for disintegrating the aggregate of magnetic particles, the impact force due to the rotor is liable to be excessively applied even to the primary particles to break the primary particles per se, whereby fine powder of magnetic material is liable to be produced. Accordingly, when the magnetic material subjected to a disintegration treatment by means of a mechanical pulverizer is used for producing a toner, the above-mentioned fine powder in the magnetic particles deteriorates the triboelectrification characteristic of the toner. As a result, a decrease in toner image density due to the decrease in the triboelectric charge amount in the toner is relatively liable to be occur.

On the other hand, in the present invention, there may preferably be used a pressure dispersing machine having a load-applying roller such as a Fret Mill, in order to effectively disintegrate the aggregates of spherical magnetic particles, and to suppress the production of magnetic material fine powder.

In the present invention, it may be considered that the packed bulk density and the oil absorption of the magnetic material indirectly represent the shape of the magnetic particles, the surface condition thereof, and the amount of the aggregate present therein.

The packed bulk density of a magnetic material of below 1.2 g/cm$^3$ indicates that a large amount of magnetic particles in a cubic crystal system is present in the magnetic material, or that a large number of magnetic particle aggregates are present therein and the disintegration treatment for the magnetic particles is substantially insufficient. Accordingly, when a magnetic material having a packed bulk density less than 1.2 g/cm$^3$ is used, it is difficult to uniformly disperse the magnetic material in a binder resin, whereby toner image blurring due to the ununiform dispersion of the magnetic material, a decrease in resolving power of the toner, and the damage of a photosensitive member surface are liable to occur.

When the packed bulk density of the magnetic particles is more than 2.5 g/cm$^3$, the aggregates thereof have excessively been disintegrated and the adhesion among the magnetic particles occurs under pressure, whereby pellets thereof are produced. As a result, such magnetic particles can only provide ununiform magnetic toner particles.

When the oil absorption of the magnetic particles overstep the above-mentioned upper or lower limit thereof, there occurs a similar phenomenon as in the case of the packed bulk density.

According to our research, it has been found that when magnetic particles in a cubic crystal system are disintegrated, the BET specific surface area thereof after the disintegration increases by 10% or more, as compared with that before the disintegration. The reason for this may be considered that fine powder of magnetic particles is produced in a large amount due to the disintegration treatment. On the other hand, it has been found that when spherical magnetic particles are disintegrated, the BET specific surface area thereof after the disintegration is substantially the same as that before the disintegration, or decrease by several percent.

Accordingly, it is possible to determine whether the shape of the magnetic particles is in a cubic crystal system or spherical. More specifically, in a case where magnetic particles are disintegrated so that the packed bulk density thereof is increased by about 30%, if the BET specific surface area thereof at this time is substantially the same or decreases as compared with that before the disintegration, the shape of the magnetic particles may be considered spherical.

In the present invention, the primary particle size of magnetic particles measured by using a photograph formed by an electron microscope may preferably be in the range of 0.1–0.35 micron, and the BET specific surface area thereof by nitrogen adsorption may preferably be 6.0–8.0 m$^2$/g.

Further, in order to develop a digital latent image in the presence of a magnetic field, the spherical magnetic particles used in the present invention may preferably have a saturation magnetization ($\sigma_s$) of 60–90 emu/g, a residual magnetization ($\sigma_r$) of 3–9 emu/g, and a coercive force ($H_c$) of 40–80 Öe, (more preferably 50–70 Öe), and/or a ratio $\sigma_r/\sigma_s$ of 0.04–0.10, as measured at a magnetic field of 10,000 Öe, for the conveyability of a magnetic toner on a developer-carrying member such as sleeve, and for a developing method wherein a digital latent image is developed in the presence of a magnetic field. It is very difficult to cause conventional magnetic particles in a cubic crystal system to have a coercive force of 40–80 Öe. Therefore, it may be considered that the above-mentioned value of coercive force indirectly indicates the shape of magnetic particles.

In the present invention, the magnetic characteristic of a magnetic material may be measured by means of a measurement device (Model: VSMP-1, mfd. by Toei Kogyo K.K.).

The magnetic toner of the present invention may preferably have an insulating property so as to have triboelectric charge. More specifically, when a voltage of 100 V is applied to the toner under a pressure of 3.0 kg/cm$^2$, the resistivity thereof may preferably be $10^{14}$ ohm.cm or higher. Therefore, in the magnetic toner of the present invention, the above-mentioned specific spherical magnetic particles are contained in an amount of 70–120 wt. parts preferably 80–110 wt. parts, per 100 wt. parts of a binder resin. If the amount of the magnetic particles is below 70 wt. parts, the conveyability of the magnetic toner on a developer-carrying member such a sleeve tends to be insufficient. On the other hand, if the amount of the magnetic particles is above 120 wt. parts, the insulating property and heat-fixability of the magnetic toner tend to decrease.

The spherical magnetic particles used in the present invention may preferably be prepared from ferrous sulfate according to a wet process. The magnetic particles may preferably comprise magnetite or ferrite which contains 0.1–10 wt. % of a compound comprising a divalent metal such as manganese or zinc.

The reason for the above-mentioned effects of the magnetic toner of the present invention is not necessarily clear but may presumably be considered as follows.

The magnetic toner of the present invention is first characterized in that it contains 17–60% by number of magnetic toner particles of 5 microns or below. Conventionally, it has been considered that magnetic toner particles of 5 microns or below are required to be positively reduced because the control of their charge amount is difficult, they impair the fluidity of the magnetic toner, and they cause toner scattering to contaminate the machine.

However, according to our investigation, it has been found that the magnetic toner particles of 5 microns or below are an essential component to form a high-quality image.

For example, we have conducted the following experiment.

Thus, there was formed on a photosensitive member a latent image wherein the surface potential on the photosensitive member was changed from a large developing potential contrast at which the latent image would easily be developed with a large number of toner particles, to a half-tone potential, further, to a small developing potential contrast at which the latent image would be developed with only a small number of toner particles.

Such a latent image was developed with a magnetic toner having a particle size distribution ranging from 0.5 to 30 microns. Then, the toner particles attached to the photosensitive member were collected and the particle size distribution thereof was measured. As a result, it was found that there were many magnetic toner particles having a particle size of 8 microns or below, particularly 5 microns or below. Based on such finding, it was discovered that when magnetic toner particles of 5 microns or below were so controlled that they were smoothly supplied for the development of a latent image formed on a photosensitive member, there could be obtained an image truly excellent in reproducibility, and the toner particles were faithfully attached to the latent image without protruding therefrom.

The magnetic toner of the present invention is secondly characterized in that it contains 5–50% by number of magnetic toner particles of 6.35–10.08 microns. Such a second feature relates to the above-mentioned necessity for the presence of the toner particles of 5 microns or below.

As described above, the toner particles having a particle size of 5 microns or below have an ability to strictly cover a latent image and to faithfully reproduce it. On the other hand, in the latent image per se, the field intensity in its peripheral edge portion is higher than that in its central portion. Therefore, toner particles sometimes cover the inner portion of the latent image in a smaller amount than that in the edge portion thereof, whereby the image density in the inner portion appears to be lower. Particularly, the magnetic toner particles of 5 microns or below strongly have such a tendency. However, we have found that when 5–50% by number of toner particles of 6.35–10.08 microns are contained in a toner, not only the above-mentioned problem can be solved but also the resultant image can be made clearer.

According to our knowledge, the reason for such a phenomenon may be considered that the toner particles of 6.35–10.08 microns have suitably controlled charge amount in relation to those of 5 microns or below, and that these toner particles are supplied to the inner portion of the latent image having a lower field intensity than that of the edge portion thereby to compensate the decrease in cover-up of the toner particles to the inner portion as compared with that in the edge portion, and to form a uniform developed image. As a result, there may be provided a sharp image having a high-image density and excellent resolution and gradation characteristic.

The third feature of the magnetic toner of the present invention is that toner particles having a particle size of 5 microns or smaller contained therein satisfy the following relation between their percentage by number (N) and percentage by volume (V):

$$N/V = -0.05\,N + k,$$

wherein $4.6 \leqq k \leqq 6.7$, and $17 \leqq N \leqq 60$.

Figure 11:
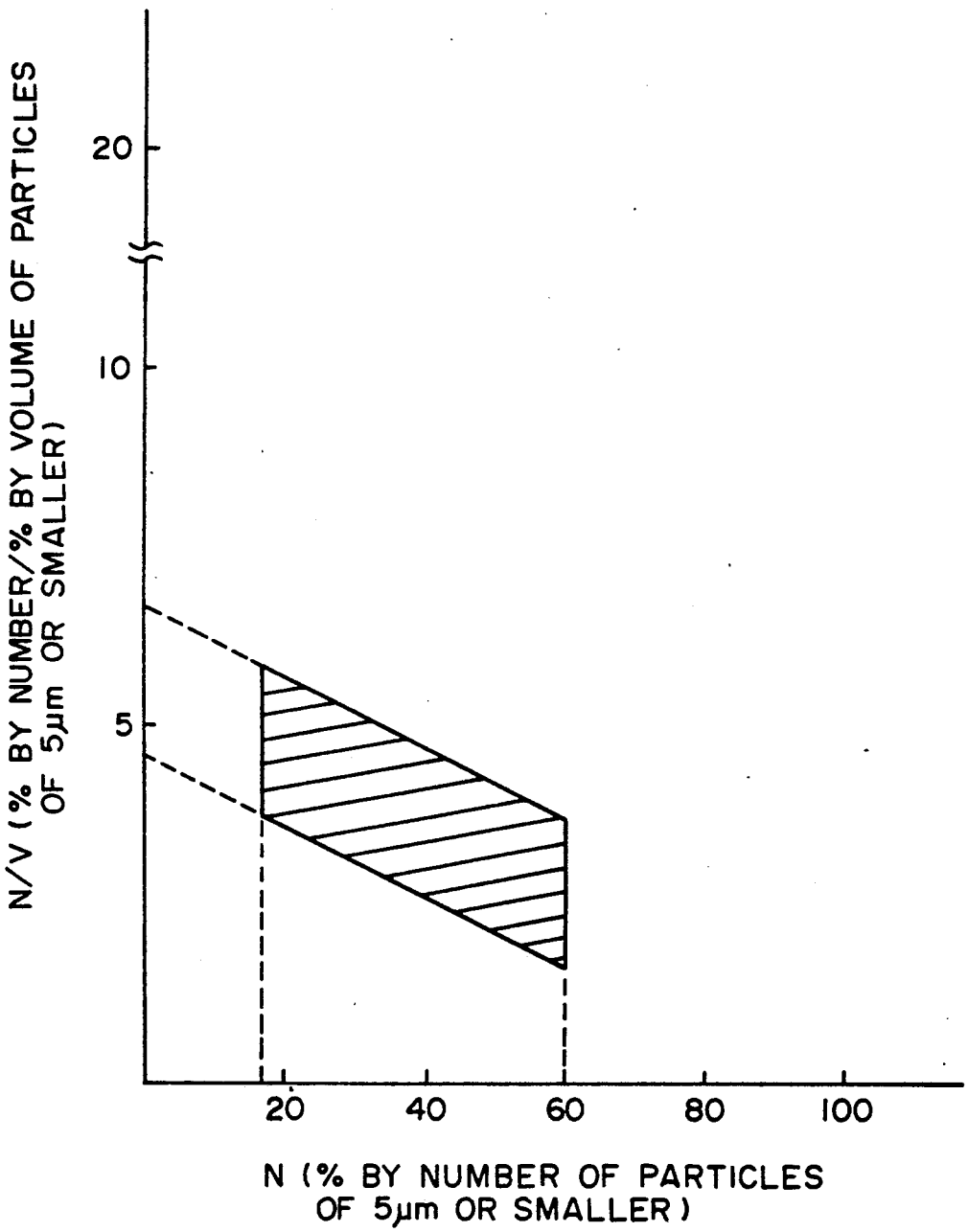
FIG. 11 is a graph obtained by plotting values of % by number (N)/(%) by volume (V) against % by number with respect to magnetic toner particles having a particle size of 5 microns or below based on the total number of the toner particles.

The region satisfying such relationship is shown in FIG. 11. The magnetic developer containing a magnetic toner according to the present invention which has the particle size distribution satisfying such a region, in addition to the above-mentioned features, can attain excellent developing characteristic with respect to a digital latent image formed from minute spots.

According to our investigation on the state of the particle size distribution with respect to toner particles of 5 microns or below, we have found that there is a suitable state of the presence of fine powder in magnetic toner particles. More specifically, in the case of a certain value of N, it may be understood that a large value of N/V indicates that the particles of 5 microns or below are significantly contained, and a small value of N/V indicates that the frequency of the presence of particles near 5 microns is high and that of particles having a smaller particle size is low. When the value of N/V is in the range of 1.6–5.85, N is in the range of 17–60, and the relation represented by the above-mentioned formula is satisfied, good thin-line reproducibility and high resolution are attained.

In the magnetic toner of present invention, magnetic toner particles having a particle size of 12.7 microns or larger are contained in an amount of 2.0% by volume or below. The amount of these particles may preferably be as small as possible.

As described hereinabove, the magnetic toner of the present invention has solved the problems encountered in the prior art, and can meet the recent severe demand for high image quality.

Hereinbelow, the present invention will be described in more detail.

In the present invention, the magnetic toner particles having a particle size of 5 microns or smaller are contained in an amount of 17–60% by number, preferably 25–60% by number, more preferably 30–60% by number, based on the total number of particles. If the amount of magnetic toner particles is smaller than 17% by number, the toner particles effective in enhancing image quality is insufficient. Particularly, as the toner particles are consumed in successive copying or print-out, the component of effective magnetic toner particles is decreased, and the particle size distribution of the magnetic toner shown by the present invention is changed to be outside of the prescribed range, whereby the image quality gradually decreases. On the other hand, the above-mentioned amount exceeds 60% by number, the magnetic toner particles are liable to be mutually agglomerated to produce toner agglomerates having a size larger than the original particle size. As a result, roughened images are provided, the resolution is lowered, and the density difference between the edge and inner portions is increased, whereby an image having an inner portion with a little low density is liable to occur.

In the magnetic toner of the present invention, the amount of particles in the range of 6.35–10.08 microns is 5–50% by number, preferably 8–40% by number. If the above-mentioned amount is larger than 50% by number, not only the image quality deteriorates but also excess development (i.e., excess cover-up of toner particles) occurs, thereby to invite a decrease in thin-line reproducibility and an increase in toner consumption. On the other hand, the above-mentioned amount is smaller than 5% by number, it is difficult to obtain a high image density.

In the present invention, the percentage by number (N %) and that by volume (V %) of magnetic toner particles having a particle size of 5 micron or below satisfy the relationship of $N/V = -0.05N + k$, wherein k represents a positive number satisfying $4.6 \leqq k \leqq 6.7$. The number k may preferably satisfy $4.6 \leqq k \leqq 6.2$, more preferably $4.6 \leqq k \leqq 5.7$. Further, as described above, the percentage N satisfies $17 \leqq N \leqq 60$, preferably $25 \leqq N \leqq 50$, more preferably $30 \leqq N \leqq 60$.

If $k < 4.6$, magnetic toner particles of 5.0 microns or below are insufficient, and the resultant image density, resolution and sharpness decrease. When fine toner particles in a magnetic toner, which have conventionally been considered useless, are present in an appropriate amount, they attain closest packing of toner in development (i.e., in a latent image formed on a photosensitive drum) and contribute to the formation of a uniform image free of coarsening. Particularly, these particles fill thin-line portions and contour portions of an image, thereby to visually improve the sharpness thereof. If $k < 4.6$ in the above formula, such component becomes insufficient in the particle size distribution, the above-mentioned characteristics become poor.

Further, in view of the production process, a large amount of fine powder must be removed by classification in order to satisfy the condition of $k < 4.6$. Such a process is disadvantageous in yield and toner costs.

On the other hand, if $k > 6.7$, an excess of fine powder is present, whereby the resultant image density is liable to decrease in successive print-out. The reason for such a phenomenon may be considered that an excess of fine magnetic toner particles having an excess amount of charge are triboelectrically attached to a developing sleeve and prevent normal toner particles from being carried on the developing sleeve and being supplied with charge.

In the magnetic toner of the present invention, the amount of magnetic toner particles having a particle size of 12.7 microns or larger is 2.0% by volume or smaller, preferably 1.0% by volume or smaller, more preferably 0.5% by volume or smaller.

If the above amount is larger than 2.0% by volume, these particles impair thin-line reproducibility.

In the present invention, the volume-average particle size of the toner is 6–8 microns. This value relates to the above-mentioned features of the magnetic toner according to the present invention. If the volume-average particle size is smaller than 6 microns, there tend to occur problems such that the amount of toner particles transferred to a transfer paper is insufficient and the image density is low, in the case of an image such as graphic image wherein the ratio of the image portion area to the whole area is high. The reason for such a phenomenon may be considered the same as in the above-mentioned case wherein the inner portion of a latent image provides a lower image density than that in the edge portion thereof. If the number-average particle size exceeds 8 microns, the resultant resolution is not good with respect to minute spots of 100 microns or smaller, and scattering to a non-image portion is considerable. Further, there tends to occur a phenomenon such that the image quality is lowered in successive print-out even when it is good in the initial stage thereof.

The particle distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg (corresponding to about 30,000 to 300,000 particles), of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner of the present invention may be obtained.

In the present invention, the true density of the magnetic developer comprising a magnetic toner (substantially equal to the true density of the magnetic toner) may preferably be 1.45–1.8 g/cm$^3$, more preferably 1.55–1.75 g/cm$^3$. When the true density is in such a range, the magnetic toner according to the present invention having a specific particle size distribution functions most effectively in view of high image quality and stability in successive use.

If the true density of the magnetic toner particles is smaller than 1.45, the weight of the particle per se is too light and there tend to occur reversal fog, and deformation of thin lines, scattering and deterioration in resolution because an excess of toner particles are attached to the latent image. On the other hand, the true density of the magnetic toner is larger than 1.8, there occurs an image wherein the image density is low, thin lines are interrupted, and the sharpness is lacking. Further, because the magnetic force becomes relatively strong in such a case, ears of the toner particles are liable to be lengthened or converted into a branched form. As a result, the image quality is disturbed in the development of a latent image, whereby a coarse image is liable to occur.

In the present invention, the true density of the magnetic toner is measured in the following manner which can simply provide an accurate value in the measurement of fine powder, while the true density can be measured in some manners.

There are provided a cylinder of stainless steel having an inside diameter of 10 mm and a length of about 5 cm, and a disk (A) having an outside diameter of about 10 mm and a height of about 5 mm, and a piston (B) having an outside diameter about 10 mm and a length of about 8 cm, which are capable of being closely inserted into the cylinder.

In the measurement, the disk (A) is first disposed on the bottom of the cylinder and about 1 g of a sample to be measured is charged in the cylinder, and the piston (B) is gently pushed into the cylinder. Then, a force of 400 Kg/cm$^2$ is applied to the piston by means of a hydraulic press, and the sample is pressed for 5 min. The weight (Wg) of thus pressed sample is measured and the diameter (D cm) and the height (L cm) thereof are measured by means of a micrometer. Based on such measurement, the true density may be calculated according to the following formula:

$$\text{True density } (g/cm^3) = W/(\pi \times (D/2)^2 \times L)$$

In order to obtain better developing characteristics, the magnetic toner of the present invention may preferably have the following magnetic characteristics: a residual magnetization $\sigma_r$ of 1–5 emu/g, more preferably 2–4.5 emu/g; a saturation magnetization $\sigma_s$ of 15–50 emu/g, more preferably 20–40 emu/g; and a coercive force Hc of 20–100 Öe, more preferably 40–100 Öe particularly preferably 40–70 Öe. These magnetic characteristics may be measured under a magnetic field for measurement of 1,000 Öe.

The binder for use in constituting the toner according to the present invention, when applied to a hot pressure roller fixing apparatus using an oil applicator, may be a known binder resin for toners. Examples thereof may include: polystyrene; homopolymers of styrene derivatives, such as poly-p-chlorostyrene, and polyvinyltoluene; styrene copolymers, such as styrene-p-chlorostyrene copolymer, styrene-vinyltoluene copolymer, styrene-vinylnaphthalene copolymer, styreneacrylate copolymer, styrene-methacrylate copolymer, styrene-methyl -chloromethacrylate copolymer, styreneacrylonitrile copolymer, styrene-vinyl methyl ether copolymer, styrene-vinyl ethyl ether copolymer, styrene-vinyl methyl ketone copolymer, styrenebutadiene copolymer, styrene-isoprene copolymer, and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumaroneindene resin and petroleum resin.

In a hot pressure roller fixing system using substantially no oil application, serious problems are provided by a so-called offset phenomenon such that a part of toner image on toner image-supporting member is transferred to a roller, and an intimate adhesion of a toner on the toner image-supporting member. As a toner fixable with a less heat energy is generally liable to cause blocking or caking in storage or in a developing apparatus, this should be also taken into consideration. With these phenomenon, the physical property of a binder resin in a toner is most concerned. According to our study, when the content of a magnetic material in a toner is decreased, the adhesion of the toner onto the toner image-supporting member mentioned above is improved, while the offset is more readily caused and also the blocking or caking are also more liable. Accordingly, when a hot roller fixing system using almost no oil application is adopted in the present invention, selection of a binder resin becomes more important. A preferred binder resin may for example be a crosslinked styrene copolymer, or a crosslinked polyester.

Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol diacrylate; divinyl compounds such as divinyl ether, divinyl sulfide and divinyl sulfone; and compounds having three or more vinyl groups. These compounds may be used singly or in a mixture. The crosslinking agent may preferably be used in an amount of 0.1–5 wt. %, preferably 0.1–2 wt. parts, with respect to 100 wt. parts of the vinyl monomer.

For a pressure-fixing system, a known binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styreneisoprene copolymer, linear saturated polyesters and paraffins.

In the magnetic toner of the present invention, it is preferred that a charge controller may be incorporated in the toner particles (internal addition), or may be mixed with the toner particles (external addition). By using the charge controller, it is possible to most suitably control the charge amount corresponding to a developing system to be used. Particularly, in the present invention, it is possible to further stabilize the balance between the particle size distribution and the charge. As a result, when the charge controller is used in the present invention, it is possible to further clarify the above-mentioned functional separation and mutual compensation corresponding to the particle size ranges, in order to enhance the image quality.

The charge control agent usable in the present invention may be a negatively chargeable charge control agent. Preferred examples of the negatively chargeable charge control agent may include; metal complexes or salts of monoazo dyes; and metal complex or salts of salicylic acid, alkylsalicylic acid, dialkylsalicylic acid or naphthoic acid.

It is preferred that the above-mentioned charge controller which does not function as a binder resin is used in the form of fine powder. In such a case, the number-average particle size thereof may preferably be 4 microns or smaller, more preferably 3 microns or smaller.

In the case of internal addition, such a charge controller may preferably be used in an amount of 0.1–10 wt. parts, more preferably 0.1–5 wt. parts, per 100 wt. parts of a binder resin.

The magnetic developer of the present invention contains hydrophobic silica fine powder.

In the magnetic toner of the present invention having the above-mentioned particle size distribution characteristic, the specific surface area thereof becomes larger than that in the conventioned toner. In a case where the magnetic toner particles are caused to contact the surface of a cylindrical electroconductive sleeve containing a magnetic field-generating means therein in order to triboelectrically charge them, the frequency of the contact between the toner particle surface and the sleeve is increased as compared with that in the conventional magnetic toner, whereby the abrasion of the toner particle or the contamination of the sleeve is liable to occur. However, when the magnetic toner of the present invention is combined with the silica fine powder, the silica fine powder is disposed between the toner particles and the sleeve surface, whereby the abrasion of the toner particle is remarkably reduced.

Thus, the life of the magnetic toner and the sleeve may be lengthened and the chargeability may stably be retained. As a result, there can be provided a developer comprising a magnetic toner showing excellent characteristics in long-time use. Further, the magnetic toner particles having a particle size of 5 microns or smaller, which play an important role in the present invention, may produce a better effect in the presence of the silica fine powder, thereby to stably provide high-quality images.

The silica fine powder may be those produced through the dry process and the wet process. The silica fine powder produced through the dry process is preferred in view of the anti-filming characteristic and durability thereof.

The dry process referred to herein is a process for producing silica fine powder through vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

On the other hand, in order to produce silica powder to be used in the present invention through the wet process, various processes known heretofore may be applied. For example, decomposition of sodium silicate with an acid represented by the following scheme may be applied:

$$Na_2O.xSiO_2+HCl+H_2O \rightarrow SiO_2.nH_2O+NaCl.$$

In addition, there may also be used a process wherein sodium silicate is decomposed with an ammonium salt or an alkali salt, a process wherein an alkaline earth metal silicate is produce from sodium silicate and decomposed with an acid to form silicic acid, a process wherein a sodium silicate solution is treated with an ion-exchange resin to form silicic acid, and a process wherein natural silicic acid or silicate is utilized.

The silica power to be used herein may be anhydrous silicon dioxide (silica), and also a silicate such as aluminum silicate, sodium silicate, potassium silicate, magnesium silicate and zinc silicate.

Among the above-mentioned silica powders, those having a specific surface area as measured by the BET method with nitrogen adsorption of 70–300 $m^2/g$, provides a good result.

In the present invention, the silica fine powder may preferably be used in an amount of 0.6–1.6 wt. parts, more preferably 0.7–1.4 wt. parts, with respect to 100 wt. parts of the magnetic toner.

In the present invention, it is preferred to use negatively chargeable hydrophobic silica fine powder. The hydrophobic silica fine powder used in the present invention may preferably be one having a triboelectric charge amount of $-100$ $\mu C/g$ to $-300$ $\mu C/g$. When the silica fine powder having a triboelectric charge of below $-100$ $\mu C/g$ is used, it decreases the triboelectric charge amount of the developer per se, whereby humidity characteristic becomes poor. When silica fine powder having a triboelectric charge amount of above $-300$ $\mu C/g$ is used, it promotes a so-called is used, it promotes a so-called "memory phenomenon" on a developer-carrying member and the developer may easily be affected by deterioration of the silica, whereby durability characteristic may be impaired. When the silica is too fine so that its BET specific surface area is above 300 $m^2/g$, the addition thereof produces a little effect. When the silica is too coarse so that its BET specific surface area is below 70 $m^2/g$, the probability of fine powder presence is increased, whereby the dispersion thereof in the toner is liable to be non-uniform. In such a case, black spots due to silica agglomerates are liable to occur.

The triboelectric charge amount of the negatively chargeable silica fine powder may be measured in the following manner.

0.2 g of silica fine powder which have been left to stand overnight in an environment of 20° C. and relative humidity of 60% RH, and 9.8 g of carrier iron powder not coated with a resin having a mode particle size of 200 to 300 mesh (e.g. EFV 200/300, produced by Nippon Teppun K.K.) are mixed thoroughly in an aluminum pot having a volume of about 50 cc in the same environment as mentioned above (by shaking the pot in hands vertically about 50 times for about 20 sec).

Figure 7:
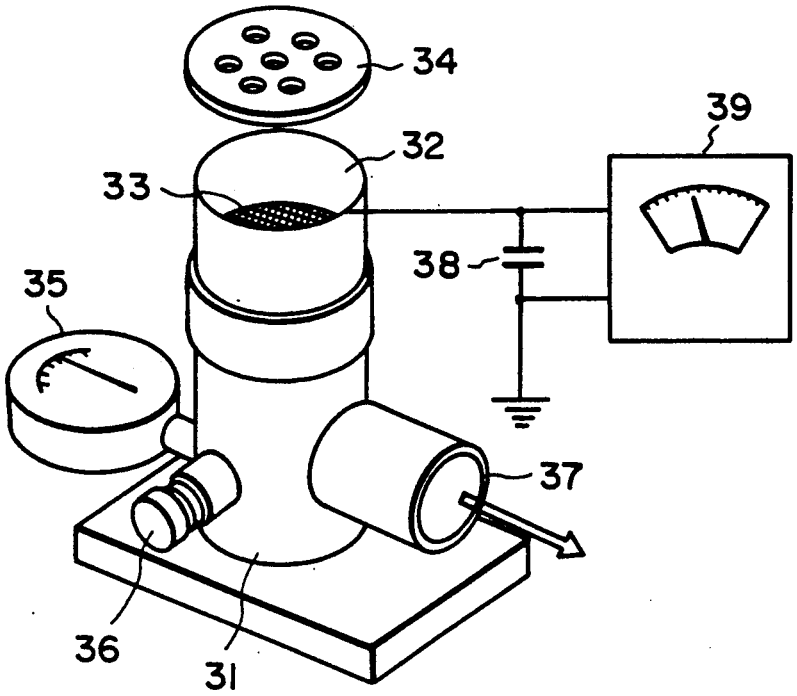
FIG. 7 is a schematic perspective view showing a device for measuring the charge amount of the hydrophobic silica or developer according to the present invention.

Then, about 0.5 g of the shaken mixture is charged in a metal container 32 for measurement provided with 400-mesh screen 33 at the bottom as shown in FIG. 7 and covered with a metal lid 34. The total weight of the container 32 is weighed and denoted by $W_1$ (g). then, an aspirator 31 composed of an insulating material at least with respect to a part contacting the container 32 is operated, and the silica in the container is removed by suction through a suction port 37 sufficiently while controlling the pressure at a vacuum gauge 35 at 250 mmHg by adjusting an aspiration control valve 36. The reading as this time of a potential meter 39 connected to the container by the medium of a capacitor having a capacitance C (uF) is denoted by V (volts.). The total weight of the container after the aspiration is measured and denoted by $W_2$ (g). Then, the triboelectric charge (uC/g) of the silica is calculated as: $CxV/(W_1-W_2)$.

The fine silica powder used in the present invention can be either the so-called "dry process silica" or "fused silica" which can be obtained by oxidation of gaseous silicon halide, or the so-called "wet process silica" which can be produced from water glass, etc. Among these, the dry process silica is preferred because the amount of the silanol group present on the surfaces or in interior of the particles is small and no production residue is provided in the production thereof.

In order to impart hydrophobicity to silica fine powder, the silica fine powder may be chemically treated with an agent which is capable of reacting with the silica fine powder or of being physically adsorbed thereinto. It is preferred that dry process silica produced by vapor-phase oxidation of silica halide is treated with a silane coupling agent and then treated with an organic silicon compound such as silicone oil and silicone varnish; or such silica is treated with a silane coupling agent and such an organic silicon compound simultaneously.

Specific examples of the silane coupling agent used for the hydrophobicity-imparting; treatment may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyltetramethyldisiloxane.

Among these, hexamethyldisilazane (HMDS) is preferred as silane coupling agent.

The silicone oil may preferably be have a viscosity of 50–1,000 centistoke at 25° C. Specific examples thereof may include dimethylsilicone oil, methylphenylsilicone oil, α-methylstyrene-modified silicone oil, chlorophenyl silicone oil, fluorine-modified silicone oil, etc. In view of the object of the present invention. Silicone oils having a large amount of a polar group such as —OH, —COOH and —$NH_2$ are not preferred.

The silane coupling agent may preferably be used for treatment in an amount of 1–50 wt. parts, more preferably 5–40 wt. parts, per 100 wt. parts of silica fine powder.

In the present invention, the silicone oil or silicone varnish may preferably be used for treatment in an amount of 1–35 wt. parts, more preferably 2–30 wt. parts, per 100 wt. parts of silica fine powder. When the amount of the treating agent is too small, humidity resistance is not substantially improved so as to provide substantially the same result as that provided only by the silane coupling agent treatment, and the silica fine powder absorbs moisture under a high-humidity condition, whereby copied images of high-quality are difficult to be obtained. When the amount of the treating agent is too large, agglomerates of silica fine powder as described above are liable to be produced and further free silicone oil is liable to occur. As a result, when the resultant silica fine powder is applied to a developer, it tends to cause a problem such that the fluidity of the developer is not sufficiently improved.

In order to treat the silica fine powder with silicone oil, there may be used a method wherein silica fine powder treated with a silane coupling agent is directly mixed with a silicone oil by means of a mixer such as Henschel mixer; a method wherein a silicone oil is sprayed on silica as a base material; or a method wherein a silicone oil is dissolved or dispersed in an appropriate solvent, the resultant liquid is mixed with silica as a base material, and then the solvent is removed.

In the present invention, the hydrophobicity of the silica fine powder may be measured in the in the following manner, while another methods can be applied with reference to the following method.

A sample in an amount of 0.1 g is placed in a 200 ml-separating funnel equipped with a sealing stopper, and 100 ml of ion-exchanged water is added thereto. The mixture is shaken for 10 min. by a Turbula Shaker Mixer model T2C at a rate of 90 r.p.m. The separating funnel is then allowed to stand still for 10 min. so that a silica powder layer and an aqueous layer are separated from each other, and 20–30 ml of the content is withdrawn from the bottom. A portion of the water is taken in a 10 mm-cell and the transmittance of the thus withdrawn water is measured by a colorimeter (wavelength: 500 nm) in comparison with ion-exchanged water as a blank containing no silica fine powder. The transmittance of the water sample is denoted as the hydrophobility of the silica.

The hydrophobic silica used in the present invention should preferably have a hydrophobicity of 90% or higher, particularly 93% or higher. If the hydrophobicity is below 90%, high-quality images cannot be attained because of moisture absorption by the silica fine powder under a high-humidity condition.

When 0.6–1.6 wt. parts of the hydrophobic silica fine powder is added to 100 wt. parts of an insulating magnetic toner, it may show an effect. When the addition amount is 0.7–1.4 wt. parts per 100 wt. parts of the toner, it may provide a developer having good stability in chargeability.

The magnetic developer according to the present invention comprising at least hydrophobic silica fine powder and an insulating magnetic toner has a BET specific surface area of 1.8 to 3.5 $m^2/g$ (preferably 1.9 to 3.0 $m^2/g$) by nitrogen adsorption, a triboelectric chargeability of −20 to −35 μc/g, an apparent density of 0.4 to 0.52 $g/cm^3$, and a true density of 1.45 to 1.8 $g/cm^3$.

When the triboelectric chargeability is below −2 μc/g, charge amount sufficient for development is not provided on a developer-carrying member and a low image density is obtained from the initial stage. When the triboelectric chargeability exceeds −35 μc/g, the amount of charge of developer particles disposed in the vicinity of the surface of a developer-carrying member becomes large in repetitive image formation, and a so-called "charge-up phenomenon" such that proper charging of the developer disposed on the developer-carrying member is impaired, whereby the resultant image density is gradually decreased. Such a phenomenon is liable to occur in the development of a digital latent image comprising dots, and it becomes marked in a reversal developing system using an OPC (organic photoconductor) photosensitive member and a small potential contrast.

When the BET specific surface area by nitrogen adsorption of the developer according to the present invention is below 1.8 $m^2/g$, it takes a long time to obtain a charge amount sufficient for development on a developer-carrying member, whereby images with much fog having a low image density are provided. When the BET specific surface area exceeds 3.5 $m^2/g$, electric force with respect to a developer-carrying member such as sleeve becomes stronger and developing efficiency is lowered, whereby the resultant image density is lowered.

In the present invention, the BET specific surface area may be measured by using a specific surface area meter (trade name: Autosorb-1, mfd. by Quantachrome Co.) according to the BET one-point method.

The developer according to the present invention has a true density of 1.45–1.8 $g/cm^3$. If the true density is below 1.45, fog is liable to occur in a developing system wherein an AC bias is applied to the developer in a magnetic field, and the line width of the resultant image is thickened to lower the resolution. When the true density exceeds 1.8, the resultant line image is liable to be blurred to decrease the image density.

The developer according to the present invention, has a aerated bulk density of 0.4–0.52, (preferably 0.45–0.5), and is characterized in that the aerated bulk density is small while it has a large true density. The void ratio calculated from the true density and aerated bulk density may preferably be 62–75%.

The void ($\epsilon_a$) may be calculated according to the following formula:

Void = (true density − apparent density)/(true density) × 100%

The packed bulk density may preferably be in the range of 0.8 to 1.0, and the void ratio ($\epsilon_p$) of packed bulk density at this time may preferably be 40–50%.

When the void ($\epsilon_a$) of the aerated bulk density is below 62%, the toner is not sufficiently disintegrated under stirring in the interior of a developing device. When the void ratio exceeds 75%, toner scattering and toner leak are liable to occur. When the void ratio ($\epsilon_p$) of packed bulk density is below 40%, clogging of the developer is liable to occur in the interior of a developing device, and the developer is not smoothly supplied to a developer-carrying member, whereby white dropouts are liable to occur. When the void ratio ($\epsilon_p$) exceeds 50%, a developing device having a greater capacity is required in order to contain the same amount of a developer, whereby miniaturization of a printer is hindered.

The aerated bulk density of the developer of the present invention may be measured by means of Powder Tester (mfd. by Hosokawa Micron K.K.) according to the procedure described in the instruction manual for the above-mentioned Powder Tester, and the packed bulk density thereof may be measured in the same manner as in that of the measurement of the above-mentioned magnetic material.

An additive may be mixed in the magnetic toner of the present invention as desired. More specifically, as a colorant, known dyes or pigments may be used generally in an amount of 0.5–20 wt. parts per 100 wt. parts of a binder resin. Another optional additive may be added to the toner so that the toner will exhibit further better performances. Optional additives to be used include, for example, lubricants such as zinc stearate; abrasives such as cerium oxide and silicon carbide; flowability improvers such as aluminum oxide; anti-caking agent; or conductivity-imparting agents such as carbon black and tin oxide.

In order to improve releasability in hot-roller fixing, it is also a preferred embodiment of the present invention to add to the magnetic toner a waxy material such as low-molecular weight polyethylene, low-molecular weight polypropylene, microcrystalline wax, carnauba wax, sasol wax or paraffin wax, preferably in an amount of 0.5–5 wt. %.

The magnetic toner for developing electrostatic images according to the present invention may be produced by sufficiently mixing magnetic powder with a vinyl on non-vinyl thermoplastic resin such as those enumerated hereinbefore, and optionally, a pigment or dye as colorant, a charge controller, another additive, etc., by means of a mixer such as ball mill, etc.; then melting and kneading the mixture by hot kneading means such as hot rollers, kneader and extruder to disperse or dissolve the pigment or dye, and optional additives, if any, in the melted resin; cooling and crushing the mixture; and subjecting the powder product to precise classification to form the insulating magnetic toner according to the present invention.

Further, the magnetic developer according to the present invention may be obtained by mixing a predetermined amount of hydrophobic silica fine powder with the insulating magnetic toner having prescribed particle size and particle size distribution.

The triboelectric charge amount of the magnetic toner and magnetic developer according to the present invention may be measured substantially in the same manner as in the case of silica fine powder as described hereinabove, while 2.0 g of the magnetic toner or developer and 9.0 g of carrier iron powder are accurately weighed, and the resultant mixture are subjected to measurement.

An embodiment of the image forming method to which the magnetic developer according to the present invention is suitably applied is described with reference to FIGS. 1 and 2.

Figure 2:
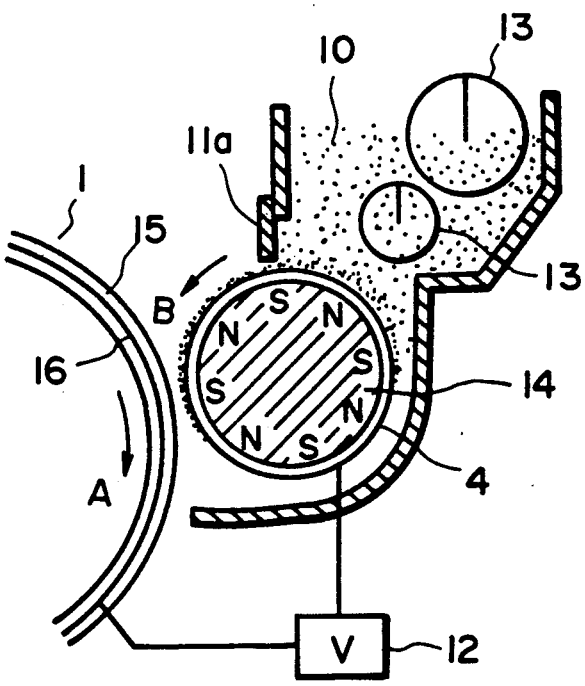
FIGS. 2, 4 and 6 are enlarged schematic sectional views each showing the developing portion of the apparatus as shown in FIGS. 1, 3 and 5, respectively.

Referring to FIGS. 1 and 2, the surface of a photosensitive member (drum) 1 is charged negatively by means of a primary charger 2, and then an exposure light 5 comprising laser is supplied to the photosensitive member surface according to an image scanning method thereby to form a digital latent image thereon. The latent image is developed with a one-component developer 10 to form a toner image in a developing position where a developing sleeve 4 of a developing device 9 is disposed opposite to the photosensitive member surface. The developing device 9 comprises a magnetic blade 11*a* and the developing sleeve 4 having a magnet 14 inside thereof, and contains the developer 10. In the developing position, a bias comprising an alternating bias, a pulse bias and/or a DC bias is applied between a electroconductive substrate 16 of the photosensitive drum 1 and the developing sleeve 4 by a bias application means 12, as shown in FIG. 2.

As shown in FIG. 1, when a transfer paper P is conveyed to a transfer position where a transfer charger 3 confronts the photosensitive drum 1, the back side surface of the transfer paper P (i.e., the surface thereof opposite to that confronting the photosensitive drum 1) is charged positively by means of the transfer charger 3, whereby the toner image comprising a negatively chargeable toner formed on the photosensitive drum surface is electrostatically transferred to the transfer paper P. Then, the transfer paper P is separated from the photosensitive drum 1, and conveyed to a fixing device 7 using heat and pressure thereby to fix the toner image to the transfer paper P.

The residual one-component developer remaining on the photosensitive drum 1 downstream of the transfer position is removed by a cleaner 8 having a cleaning blade. The photosensitive drum 1 after the cleaning is discharged by erase exposure 6, and again subjected to the above-mentioned process including the charging step based on the primary charger 2, as the initial step.

Referring again to FIG. 2, the photosensitive drum 1, as an electrostatic image-bearing member, comprises the electroconductive substrate 16 and a photosensitive layer 15 disposed thereon, and moves in the direction of an arrow A. On the other hand, the developing sleeve 4 of a nonmagnetic cylinder, as a developer-carrying member, rotates in the direction of an arrow B so as to move in the same direction as that of the photosensitive drum 1 in the developing position. The multipolar permanent magnet 14 (i.e., magnet roller) is disposed inside the nonmagnetic cylinder 4 so as not to rotate.

The one-component insulating magnetic developer 10 contained in the developing apparatus 9 is applied onto the nonmagnetic sleeve 4, and the toner particles contained therein are supplied with negative triboelectric charge on the basis of the friction between the sleeve 4 surface and the toner particles. A magnetic doctor blade of iron 11*a* is disposed close to the sleeve surface (preferably at a clearance of 50–500 microns) and opposite to one of the poles of the multipolar permanent magnet 14. Thus, the thickness of the toner layer disposed on the sleeve 4 is regulated uniformly and thinly (preferably in a thickness of 30–300 microns), to form a developer layer having a thickness smaller than the clearance between the photosensitive drum 1 and the sleeve 4 in the developing position so that the developer layer formed on the sleeve 4 does not contact the image bearing member 1. The rotating speed of the sleeve 4 may be regulated so that the speed of the surface thereof is substantially the same as (or close to) the speed of the photosensitive drum 1 surface.

The magnetic doctor blade 11*a* may also comprise a permanent magnet instead of iron thereby to form a counter magnetic pole. An AC bias or pulse bias may be applied between the sleeve 4 and the photosensitive drum 1 by means of the bias application means 12. The AC bias may preferably have a frequency of 200–4,000 Hz, and a Vpp (peak-to-peak value) of 500–3,000 V. In the developing position, the toner particles are transferred to an electrostatic image formed on the photosensitive drum 1 under the action of an electrostatic force due to the electrostatic image-bearing surface, and under the action of the AC bias or pulse bias.

In the above-mentioned embodiment, an elastic blade comprising an elastic or elastomeric material such as silicone rubber may also be used instead of the doctor blade 11*a*, so that the developer is applied onto the developer-carrying member 4 while the thickness of the developer layer is regulated under pressure.

In the image forming apparatus and image forming method according to the present invention, it is preferred to use a toner-carrying member coated with a phenolic resin containing electroconductive carbon and graphite. The image forming apparatus according to the present invention may comprise a device unit (e.g., a device unit of cartridge-type) into which an electrostatic image-bearing member, a cleaning means, a toner-carrying member, etc., have unitedly been assembled.

In such a system, since the surface of the toner-carrying member is covered with a phenolic resin film containing electroconductive carbon and graphite, a toner component is less liable to adhere to the surface and the contamination thereof may be prevented or reduced for a long time. Further, since the charge amount of the toner may suitably be regulated, a stable toner coating layer may constantly be formed, whereby clear images having a high image density may be provided.

Hereinbelow, the toner-carrying member is referred to as "sleeve", layer thickness-regulation means is referred to as "blade", and the latent image-bearing member is referred to as "drum".

In a preferred embodiment of the present invention, the sleeve comprises a cylindrical base member comprising nonmagnetic stainless steel, aluminum, etc., coated with a phenolic resin containing electroconductive carbon and graphite. In such an embodiment, the phenolic resin is used because a toner component is less liable to adhere to such a resin and the resin has an appropriate chargeability to the toner. Since the above-mentioned phenolic resin is appropriately distant from the toner in triboelectric charging series, and the resultant charge amount of the toner does not become too large nor too small.

The phenolic resin may generally be a thermosetting resin and have a relatively large hardness among ordinary thermosetting resins. Since the phenolic resin has a dense three-dimensional structure based on thermal hardening reaction, it may form a very hard coating film, whereby it provides excellent durability which is hardly provided by other resins. Accordingly, when the coating layer on a sleeve is formed from such a resin, scratches and peeling of the coating film are prevented, whereby stable image quality may constantly be obtained. The phenolic resin may include simple phenolic resins formed from phenol and formaldehyde; and modified phenolic resins prepared by a combination of ester gum and a simple phenolic resin. Each of these two types of phenolic resins may be used in the present invention.

In the present invention, electroconductive carbon and graphite may preferably be contained in the coating film on the sleeve. These electroconductive carbon and graphite may form appropriate unevenness on the sleeve surface and may appropriately leak remaining charges on the sleeve coating film to the sleeve substrate, whereby a stable magnetic toner coating layer may constantly be obtained.

We have investigated metals such as gold, silver, copper, lead and tin; and metal oxides such as tin oxide, indium oxide, antimony oxide, and tungsten oxide, but it has been found that these materials do not provide sufficient characteristic as compared with electroconductive carbon and graphite. According to our investigation, a combination of electroconductive carbon and graphite has shown an excellent characteristic.

Preferred examples of the electroconductive carbon used in the present invention may include: those having a resistance of 0.5 ohm.cm or below under a pressure of 120 kg/cm$^2$, such as oil furnace, acetylene black and Ketjen Black. The graphite used in the present invention may be a crystalline mineral having a gloss of gray or black, and a lubricating property, and may be either a natural product or an artificial product.

Another additive can also be added to the coating film of the sleeve according to the present invention, in addition to the electroconductive carbon and graphite. Specific examples of such an additive may include: surface-coarsening agent capable of regulating surface unevenness of the coating film; a charge control agent capable of controlling the charging amount of the toner.

The mixing ratio of (electroconductive carbon/graphite) may preferably be 1/10 to 100/1, more preferably 1/1 to 100/1. The ratio of such a resultant mixture to the phenolic resin may preferably be ⅓ to 2/1. When the electroconductive carbon, graphite and phenolic resin are used so that they satisfy the above-mentioned mixing ratios, the coating film on the sleeve may have appropriate unevenness, an appropriate resistance and is very little contaminated with a toner component so that it has high durability. As a result, a stable toner layer may constantly be obtained and stable image density and image quality may be obtained for a long time.

The blade used in the present invention may be either a metal blade disposed opposite to the sleeve with a predetermined gap or clearance; or an elastic (or elastomeric) blade contacting the sleeve surface with its elasticity. Among these, the elastic blade is preferred in the present invention.

The elastic blade may comprise: an elastomeric or rubbery material such as silicon rubber and NBR (nitrile-butadiene rubber); an elastic synthetic resin such as polyethylene terephthalate, or an elastic metal such as stainless steel and steel, etc.

The upper portion of the blade (i.e., base portion) may be fixed to a developer container side, and the lower portion thereof may be caused to contact the sleeve surface with appropriate elasticity so that the direction of the bent blade is the same as or counter to that of the moving direction of the developing sleeve so that the inner side of the bent blade contacts the sleeve surface (or the outer side of the blade contacts the sleeve surface in the case of the counter direction).

FIGS. 3, 4, 5 and 6 schematically show some embodiments of the image forming apparatus according to the present invention. When such image forming apparatus are used, a thin and dense toner layer may more stably be provided, even when an environmental condition changes. The reason for this is not necessarily be clear but may presumable be considered as follows.

Thus, in such an arrangement, the toner particles are forcibly be rubbed with the sleeve surface due to the elastic blade, as compared with in an apparatus wherein an ordinary metal blade is disposed opposite to a sleeve with a certain gap. As a result, the toner may constantly be charged in substantially the same state, regardless of changes in toner performances due to an environmental change.

A preferred embodiment of the image forming method or apparatus according to the present invention is described with reference to FIGS. 3 and 4.

Figure 3:
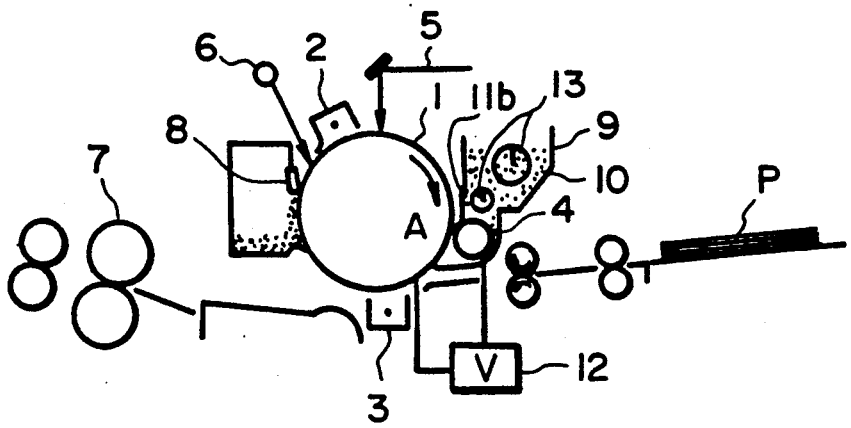
Figure 4:
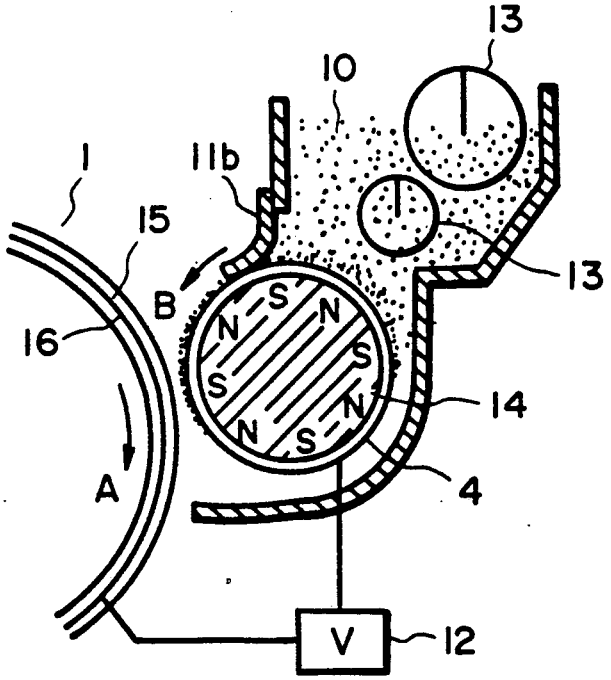
Figure 5:
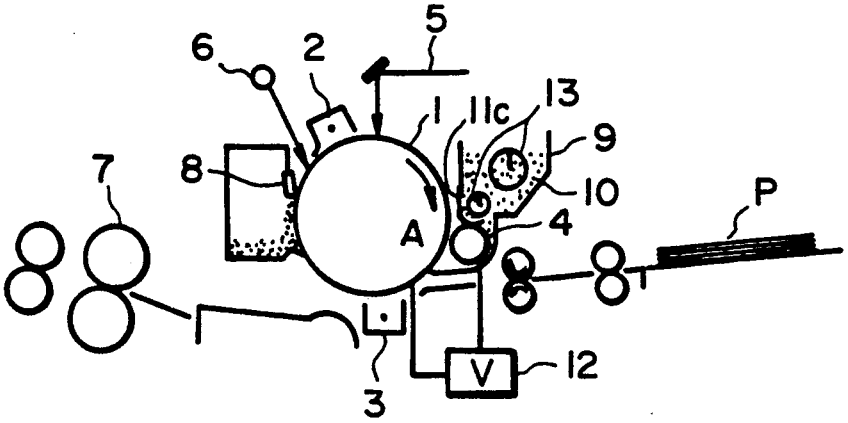
Figure 6:
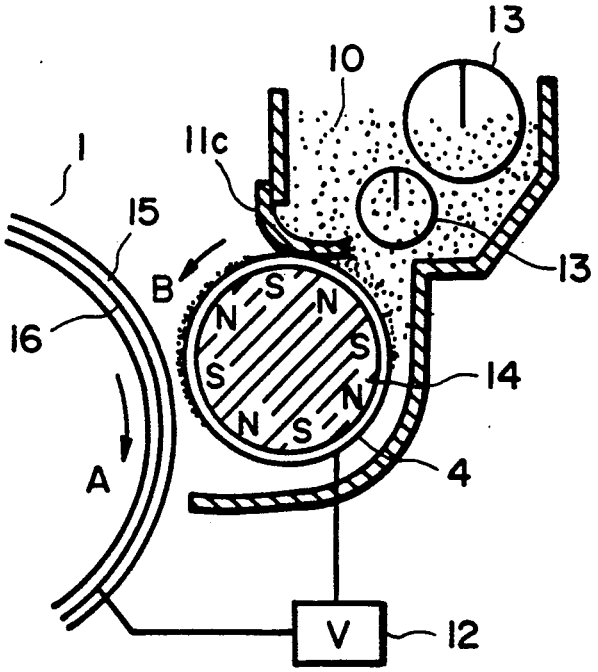

Referring to FIGS. 3 and 4, the surface 15 of a photosensitive member (drum) 1 is charged negatively by means of a primary charger 2, and then an exposure light 5 comprising laser is supplied to the photosensitive member surface 15 according to an image scanning method thereby to form a digital latent image thereon. The latent image is developed with a one-component magnetic developer 10 to form a toner image in a developing position where a developing sleeve 4 of a developing device 9 is disposed opposite to the photosensitive member surface. The developing device 9 comprises an elastic blade **11*b* and the developing sleeve 4 having a magnet 14 inside thereof, and contains the one-component developer 10. The developing sleeve 4 is coated with a phenolic resin containing electroconductive carbon and graphite. In the developing position, a bias comprising an alternating bias, and/or a DC bias is applied between a electroconductive substrate 16 of the photosensitive drum 1 and the developing sleeve 4 by a bias application means 12, as shown in FIG. 4**.

As shown in FIG. 3, when a transfer paper P is conveyed to a transfer position where a transfer charger 3 confronts the photosensitive drum 1, the back side surface of the transfer paper P (i.e., the surface thereof opposite to that confronting the photosensitive drum 1) is charged positively by means of the transfer charger 3, whereby the toner image comprising a negatively chargeable toner formed on the photosensitive drum surface is electrostatically transferred to the transfer paper P. Then, the transfer paper P is separated from the photosensitive drum 1, and conveyed to a fixing device 7 using heat and pressure thereby to fix the toner image to the transfer paper P.

The residual one-component developer remaining on the photosensitive drum 1 downstream of the transfer position is removed by a cleaner 8 having a cleaning blade. The photosensitive drum 1 after the cleaning is discharged by erase exposure 6, and again subjected to the above-mentioned process including the charging step based on the primary charger 2, as the initial step.

Referring again to FIG. 4, the photosensitive drum 1, as an electrostatic image-bearing member, comprises a photosensitive layer 15 and the electroconductive substrate 16, and moves in the direction of an arrow A. On the other hand, the developing sleeve 4 of a nonmagnetic cylinder, as a developer-carrying member, rotates in the direction of an arrow B so as to move in the same direction as that of the photosensitive drum 1 in the developing position. The multipolar permanent magnet 14 is disposed inside the nonmagnetic cylinder 4 so as not to rotate.

The one-component insulating magnetic developer 10 contained in the developing apparatus 9 is applied onto the developing sleeve 4 by means of an elastic blade **11*b*** to form a thin coating layer, and the toner particles contained therein are supplied with triboelectric charge on the basis of the friction between the sleeve surface and the toner particles.

An AC bias may be applied between the sleeve 4 and the photosensitive drum 1 by means of the bias application means 12. The AC bias may preferably have a frequency of 200–4,000 Hz, and a Vpp (peak-to-peak value) of 500–3,000 V. In the developing position, the toner particles are transferred to an electrostatic image formed on the photosensitive drum 1 under the action of an electrostatic force due to the electrostatic image-bearing surface, and under the action of the AC bias.

The toner container may preferably be provided with stirring means 13 in the interior thereof, so that the toner 10 contained in the toner container 9 may positively be fed to the vicinity of the developing sleeve. As a result, such an arrangement is effective in forming a uniform toner layer just before the toner is used up.

Figure 15:
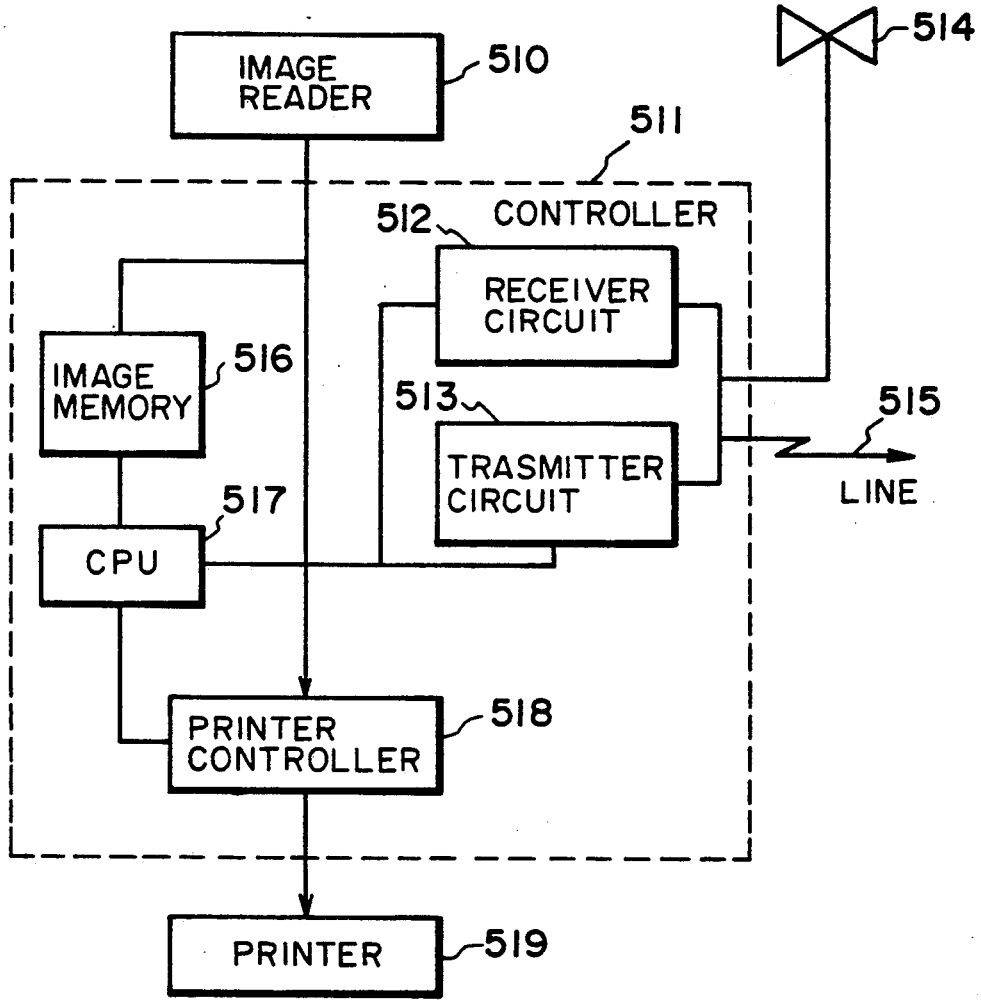
FIG. 15 is a block diagram of a facsimile machine using the image forming apparatus according to the present invention as a printer.

In a case where the image forming apparatus according to the present invention is used as a printer for facsimile, the image exposure L corresponds to that for printing received data. FIG. 15 shows such an embodiment by using a block diagram.

Referring to FIG. 15, a controller 511 controls an image reader (or image reading unit) 510 and a printer 519. The entirety of the controller 511 is regulated by a CPU 517. Read data from the image reader 510 is transmitted through a transmitter circuit 513 to another terminal such as facsimile. On the other hand, data received from another terminal such as facsimile is transmitted through a receiver circuit 512 to a printer 519. An image memory 516 stores prescribed image data. A printer controller 518 controls the printer 519. In FIG. 15, reference numeral 514 denotes a telephone system.

More specifically, an image received from a line (or circuit) 515 (i.e., image information received a remote terminal connected by the line) is demodulated by means of the receiver circuit 512, decoded by the CPU 517, and sequentially stored in the image memory 516. When image data corresponding to at least one page is stored in the image memory 516, image recording is effected with respect to the corresponding page. The CPU 517 reads image data corresponding to one page from the image memory 516, and transmits the decoded data corresponding to one page to the printer controller 518. When the printer controller 518 receives the image data corresponding to one page from the CPU 517, the printer controller 518 controls the printer 519 so that image data recording corresponding to the page is effected. During the recording by the printer 519, the CPU 517 receives another image data corresponding to the next page.

Thus, receiving and recording of an image may be effected by means of the apparatus shown in FIG. 15 in the above-mentioned manner.

The present invention will be explained in more detail with reference to Examples, by which the present invention is not limited at all. In the following formulations, parts are parts by weight.

EXAMPLE 1

| | |
|---|---|
| Graphite (trade name: CPS, mfd. by Nihon Kokuen) | 7 parts |
| Electroconductive carbon (trade name: Conductex 900, mfd. by Columbian Chemical Company) | 3 parts |
| Phenolic resin | 10 parts |
| Isopropyl alcohol | 80 parts |

The above materials were mixed and dispersed by means of a sand mil, and the resultant mixture was then applied onto the peripheral surface of a 20 mm-diameter aluminum cylinder for a sleeve by spraying and dried to form thereon a 6 micron-thick surface coating film. The resultant coated sleeve was used as "Sleeve A" and a developing device was assembled by using the Sleeve A and a 1 mm-thick elastic rubbery blade (Blade A) comprising polyurethane contacting the Sleeve A, as shown in FIG. 4.

Separately, a negatively chargeable insulating developer was prepared in the following manner.

Spherical magnetic particles having a packed bulk density of 1.0 g/cm$^3$, a linseed oil absorption of 25 ml/100 g and a BET specific surface area of 7 m$^2$/g (average particle size=0.22 micron) were subjected to a disintegration treatment by means of a Fret mill to disintegrate the aggregates of the magnetic particles, thereby to prepare spherical magnetic particles having a packed bulk density (or packed bulk density) of 1.7 g/cm$^3$, a linseed oil absorption of 17 ml/100 g, and a BET specific surface area of 7 m$^2$/g. The thus prepared spherical magnetic particles had a saturation magnetization ($\sigma_s$) of 85 emu/g, a residual magnetization ($\sigma_r$) of 5 emu/g, a ratio of $\sigma_r/\sigma_s$ of 0.06, and a coercive force of 56 Öe.

| | |
|---|---|
| The above-mentioned spherical magnetic particles after disintegration | 100 wt. parts |
| Crosslinked styrene-butyl acrylate copolymer (copolymerization weight ratio = 8:2, weight-average molecular weight: about 250,000) | 100 wt. parts |
| Low-molecular weight polypropylene | 3 wt. parts |
| Chromium complex of monoazo dye (Negatively chargeable charge controller) | 0.5 wt. parts |

The above components were melt-kneaded by means of a two-axis extruder heated up to 130° C., and the kneaded product, after cooling, was coarsely crushed by means of a hammer mill, and then finely pulverized by means of a jet mill. The finely pulverized product was classified by means of a fixed-wall type wind-force classifier to obtain a classified powder product. Ultrafine powder and coarse power were simultaneously and precisely removed from the classified powder by means of a multi-division classifier utilizing a Coanda effect (Elbow Jet Classifier available from Nittetsu Kogyo K.K.), thereby to obtain black fine powder (magnetic toner) having a volume-average particle size of 6.5 microns. When the thus obtained black fine powder was mixed with iron powder carrier and thereafter the triboelectric charge thereof was measured, it showed a value of −15 μC/g. The resultant magnetic toner as black fine powder had a residual magnetization ($\sigma_r$) of 2.5 emu/g, a saturation magnetization ($\sigma_s$) of 37 emu/g, and a coercive force of 52 Öe.

The number-basis distribution and volume-basis distribution of the thus obtained magnetic toner of negatively chargeable black fine powder was measured by means of a Coulter counter Model TA-II with a 100 micron-aperture in the above-described manner. The thus obtained results are shown in the following Table 1.

TABLE 1

| Size (μm) | Number of particles | % by number (N) Distribution | % by number (N) Cumulation | % by volume (V) Distribution | % by volume (V) Cumulation |
|---|---|---|---|---|---|
| 2.00–2.52 | 2391 | 2.4 | 2.4 | 0.0 | 0.0 |
| 2.52–3.17 | 4983 | 7.3 | 7.3 | 0.4 | 0.4 |
| 3.17–4.00 | 9612 | 9.5 | 16.9 | 1.7 | 2.1 |
| 4.00–5.04 | 17527 | 17.4 | 34.3 | 6.4 | 8.4 |
| 5.04–6.35 | 22032 | 21.9 | 56.2 | 14.8 | 23.3 |
| 6.35–8.00 | 22587 | 22.4 | 78.6 | 27.4 | 50.7 |
| 8.00–10.08 | 16865 | 16.8 | 95.4 | 32.9 | 83.6 |
| 10.08–12.70 | 4491 | 4.5 | 99.8 | 15.3 | 98.9 |
| 12.70–16.00 | 181 | 0.2 | 100.0 | 1.1 | 100.0 |
| 16.00–20.20 | 1 | 0.0 | 100.0 | 0.0 | 100.0 |
| 20.20–25.40 | 1 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

100 wt. parts of the above magnetic toner were mixed with 1.0 part of negatively chargeable hydrophobic silica having a chargeability of −240 μc/g treated with dimethyldichlorosilane and silicone oil, by means of a Henschel mixer. Then, the resultant mixture was passed through a 100-mesh (Tyler mesh) screen, whereby powder passing through the screen was used as a Developer A.

The resultant Developer A had a triboelectric chargeability of −28 μC/g, a aerated bulk density of 0.48 g/cm$^2$, a packed bulk density of 0.90 g/cm$^3$, a true density of 1.65 g/cm$^3$, and a void ($\epsilon_a$) of 71% calculated from the aerated bulk density and true density.

The magnetic developer was subjected to an image formation test by using a commercially available copying machine (trade name: Laser Beam Printer LBP8AJ1, mfd. by Canon K.K.) having a laminate-type photosensitive drum comprising organic photoconductor (OPC), and comprising a cartridge unit which had been modified by assembling therein the above-mentioned developing device. In the image formation, the surface of the photosensitive drum was primarily charged to −700 V and then the surface was supplied with a laser beam corresponding to an original image thereby to form a digital latent image wherein the exposed portion supplied with the laser beam had a potential of −100 V. The latent image was developed with the magnetic toner according to a reversal development method, while a DC bias of −500 V and an AC bias of 1800 Hz and 1600 V (peak-to-peak value) were applied.

In this instance, image formation of 10,000 sheets was conducted in an intermittent mode (three sheets per 1 min) under three sets of conditions including normal temperature-normal humidity (25° C., 60% RH) condition, high temperature-high humidity (30° C., 90% RH) condition, and low temperature-low humidity (15° C., 10% RH) condition. The results are shown in Table 3 appearing hereinafter.

The Dmax in Table 3 was obtained by measuring the image density of a square solid black image (5 mm×5 mm). The reproducibility of minute dot was obtained by developing a latent image corresponding to a checkered pattern comprising squares (the length of one side (x)=80 or 50 microns) under low temperature-low humidity conditions, and observing the reproducibility of the resultant image with an optical microscope (magnification=100) to evaluate the sharpness of the image and toner scattering in the non-image portion.

As apparent from Table 3, high-density images having an excellent minute dot reproducibility were stably obtained till 10,000 sheets under any of the above-mentioned respective sets of conditions. Further, under any of these sets of conditions, the toner coating amount on the sleeve after image formation of 10,000 sheets was about 1.2 mg/cm$^2$, which was not substantially changed as compared with that in the initial stage.

The particle size distribution and charging amount of toners used in Examples and Comparative Examples appearing hereinafter are inclusively shown in Table 2 appearing hereinafter, and evaluation results are inclusively shown in Table 3 appearing hereinafter.

Hereinbelow, the multi-division classifier and the classification step used in this instance are explained with reference to FIGS. 8 and 9.

Figure 8:
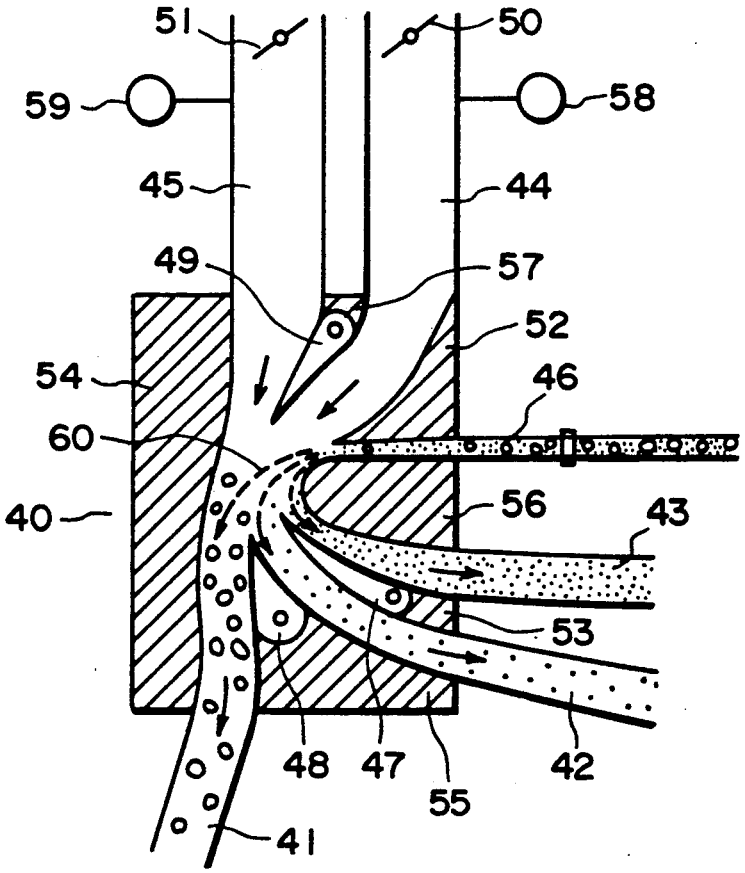
FIGS. 8 and 9 are a front sectional view and a sectional perspective view, respectively, of an apparatus embodiment for practicing multi-division classification of a magnetic toner used in Examples.
Figure 9:
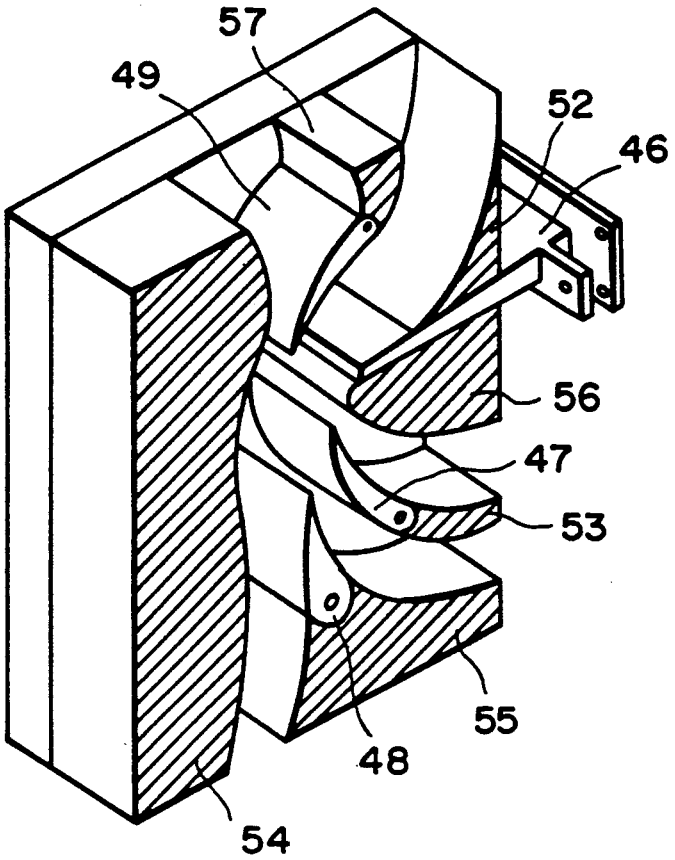

Referring to FIGS. 8 and 9, the multi-division classifier has side walls 52, 53 and 54, and a lower wall 55. The side wall 53 and the lower wall 55 are provided with knife edge-shaped classifying wedges 47 and 48, respectively, whereby the classifying chamber is divided into three sections. At a lower portion of the side wall 52, a feed supply nozzle 46 opening into the classifying chamber is provided. A Coanda block 56 is disposed along the lower tangential line of the nozzle 46 so as to form a long elliptic arc shaped by bending the tangential line downwardly. The classifying chamber has an upper wall 57 provided with a knife edge-shaped gas-intake wedge 49 extending downwardly. Above the classifying chamber, gas-intake pipes 44 and 45 opening into the classifying chamber are provided. In the intake pipes 44 and 45, a first gas introduction control means 50 and a second gas introduction control means 51, respectively, comprising, e.g., a damper, are provided; and also static pressure gauges 58 and 59 are disposed communicatively with the pipes 44 and 45, respectively. At the bottom of the classifying chamber, exhaust pipes 41, 42 and 43 having outlets are disposed corresponding to the respective classifying sections and opening into the chamber.

Feed powder to be classified is introduced into the classifying zone through the supply nozzle 46 under reduced pressure. The feed powder thus supplied are caused to fall along curved lines 60 due to the Coanda effect given by the Coanda block 56 and the action of the streams of high-speed air, so that the feed powder is classified into coarse powder 41, black fine powder 42 having prescribed volume-average particle size and particle size distribution, and ultra-fine powder 43.

REFERENCE EXAMPLE 1

Evaluation was conducted in the same manner as in Example 1 except for using an aluminum Sleeve B which had been subjected to blasting treatment using irregularly-shaped particles, and Blade B, a magnetic iron blade disposed opposite to the sleeve with a gap of 250 microns.

As shown in Table 3, the sleeve was considerably contaminated and the resultant image density was considerably decreased as compared with that in the initial image, after image formation of 10,000 sheets.

EXAMPLE 2

Evaluation was conducted in the same manner as in Example 1 except for using a Developer B containing 1.4 parts of hydrophobic silica used in Example 1. Good results similar to those in Example 1 were provided.

EXAMPLE 3

Evaluation was conducted in the same manner as in Example 1 except for using a Toner C having a volume-average particle size distribution of 7.9 microns and a particle size distribution as shown in Table 2 which had been prepared in a similar manner as in Example 1. Good results similar to those in Example 1 were provided.

COMPARATIVE EXAMPLE 1

Evaluation was conducted in the same manner as in Example 1 except for using a Toner D. The Toner D comprised a magnetic material predominantly comprising magnetic particles in a cubic crystal system having a packed bulk density of 0.4 g/cm$^2$, a linseed oil absorption of 34 ml/100 g and a BET specific surface area of 7 m$^2$/g and not being subjected to disintegration treatment, instead of the spherical magnetic particles used in Example 1.

As a result, the reproducibility of minute dot was inferior to that in Example 1, and the image density was somewhat low, as shown in Table 3.

COMPARATIVE EXAMPLE 2

Evaluation was conducted in the same manner as in Example 1, except for using a Toner E prepared by using untreated silica instead of the hydrophobic silica used in Example 1.

As a result, the image density was low and consider fog was observed, as shown in Table 3. Further, the minute dot reproducibility was poor.

COMPARATIVE EXAMPLE 3

Evaluation was conducted in the same manner as in Example 1 except for using a Toner F having a volume-average particle size of 11.4 microns and a particle size distribution as shown in Table 2 which had been prepared in a similar manner as in Example 1 by using 60 parts of spherical magnetic particles used in Example 1.

As a result, the minute dot reproducibility was poor and considerable scattering was observed.

TABLE 2

| | Particle size distribution of toner | | | | | |
|---|---|---|---|---|---|---|
| | % by number of particles ≦5 μm | % by volume of particles ≧12.7 μm | % by number of particles 6.35–10.08 μm | Volume-average particle size (μm) | (% by number)/(% by volume) of particles ≦5 μm | Charge amount of toner (μc/g) |
| Developer A (Toner A) | 34.3 | 1.1 | 39.2 | 6.5 | 4.08 | −28.0 |
| Developer B (Toner B) | 34.3 | 1.1 | 39.2 | 6.5 | 4.08 | −33.1 |
| Developer C (Toner C) | 29.6 | 1.6 | 39.4 | 7.9 | 3.75 | −26.8 |
| Developer D (Toner D) (Comp. Ex. 1) | 36.1 | 0.9 | 37.5 | 6.4 | 3.89 | −26.3 |
| Developer E (Toner A) (Comp. Ex. 2) | 34.3 | 1.1 | 39.2 | 6.5 | 4.08 | −15.4 |
| Developer F (Toner F) (Comp. Ex. 3) | 8.2 | 10.0 | 48.0 | 11.4 | 20.9 | −27.2 |

TABLE 3

| | | | | Initial stage | | | | | After 10,000 sheets | | | | | | |
|---|---|---|---|---|---|---|---|---|---|---|---|---|---|---|---|
| | | | | Dmax | | | Minute dot reproducibility | | Dmax | | | Minute dot reproducibility | | Toner coating state | Image quality, etc. |
| | Sleeve | Blade | Developer | N/N | H/H | L/L | 80μ | 50μ | N/N | H/H | L/L | 80μ | 50μ | | |
| Ex. 1 | A | A | A | 1.4 | 1.4 | 1.45 | o | o | 1.45 | 1.45 | 1.45 | o | o | o | |
| Ref. Ex. 1 | B | B | A | 1.4 | 1.35 | 1.35 | o | o | 1.0 | 1.0 | 0.85 | x | x | *1 | *2 |
| Ex. 2 | A | A | B | 1.4 | 1.4 | 1.4 | o | o | 1.45 | 1.45 | 1.4 | o | o | o | |
| Ex. 3 | A | A | C | 1.4 | 1.4 | 1.4 | o | o Δ | 1.4 | 1.4 | 1.4 | o | o Δ | o | |
| Comp. Ex. 1 | A | A | D | 1.3 | 1.3 | 1.3 | o | Δ | 1.3 | 1.3 | 1.3 | Δ | Δ | o | *3 |
| Comp. Ex. 2 | A | A | E | 1.15 | 0.9 | 1.2 | Δ | Δ | 1.2 | 0.8 | 1.2 | Δ | Δ | o | *4 |
| Comp. Ex. 3 | A | A | F | 1.35 | 1.35 | 1.35 | Δ | x | 1.4 | 1.4 | 1.4 | Δ | x | o | *5 |

N/N: normal temperature - normal humidity condition
H/H: high temperature - high humidity condition
L/L: low temperature - low humidity condition
*1: Toner coating was thin under low temperature - low humidity condition.
*2: Sleeve was contaminated and considerable fog was observed.
*3: Considerable toner scattering was observed.
*4: Considerable fog was observed.
*5: More considerable fog was observed. The edge portion of the resultant image was unclear.

EXAMPLE 4

Spherical magnetic particles having a packed bulk density of 1.0 g/cm$^3$, a linseed oil absorption of 25 ml/100 g and a BET specific surface area of 7 m$^2$g (average particle size=0.22 micron) were subjected to a disintegration treatment by means of a Fret mill to disintegrate the aggregates of the magnetic particles, thereby to prepare spherical magnetic particles having a packed bulk density of 1.7 g/cm$^3$, a linseed oil absorption of 17 ml/100 g, and a BET specific surface area of 7 m$^2$/g. The thus prepared spherical magnetic particles had a saturation magnetization ($\sigma_s$) of 85 emu/g, a residual magnetization ($\sigma_r$) of 5 emu/g, a ratio of $\sigma_r/\sigma_s$ of 0.06, and a coercive force of 56 Öe.

| | |
|---|---|
| The above-mentioned spherical magnetic particles after disintegration | 100 wt. parts |
| Styrene-butyl acrylate copolymer (copolymerization weight ratio = 8:2, weight-average molecular weight: about 250,000) | 100 wt. parts |
| Low-molecular weight polypropylene | 3 wt. parts |
| Chromium complex of monoazo dye (Negatively chargeable charge controller) | 0.5 wt. parts |

The above components were melt-kneaded by means of a two-axis extruder heated up to 130° C., and the kneaded product, after cooling, was coarsely crushed by means of a hammer mill, and then finely pulverized by means of a jet mill. The finely pulverized product was classified by means of a fixed-wall type wind-force classifier to obtain a classified powder product. Ultrafine powder and coarse power were simultaneously and precisely removed from the classified powder by means of a multi-division classifier utilizing a Coanda effect (Elbow Jet Classifier available from Nittetsu Kogyo K.K.) thereby to obtain black fine powder (magnetic toner) having a number-average particle size of 6.5 microns. When the thus obtained black fine powder was mixed with iron powder carrier and thereafter the triboelectric charge thereof was measured, it showed a value of −15 μC/g.

The number-basis distribution and volume-basis distribution of the thus obtained magnetic toner of negatively chargeable black fine powder was measured by means of a Coulter counter Model TA-II with a 100 micron-aperture in the above-described manner. The thus obtained results are shown in the following Table 4.

TABLE 4

| Size (μm) | Number of particles | % by number (N) Distribution | % by number (N) Cumulation | % by volume (V) Distribution | % by volume (V) Cumulation |
|---|---|---|---|---|---|
| 2.00–2.52 | 2391 | 2.4 | 2.4 | 0.0 | 0.0 |
| 2.52–3.17 | 4983 | 7.3 | 7.3 | 0.4 | 0.4 |
| 3.17–4.00 | 9612 | 9.5 | 16.9 | 1.7 | 2.1 |
| 4.00–5.04 | 17527 | 17.4 | 34.3 | 6.4 | 8.4 |
| 5.04–6.35 | 22032 | 21.9 | 56.2 | 14.8 | 23.3 |
| 6.35–8.00 | 22587 | 22.4 | 78.6 | 27.4 | 50.7 |
| 8.00–10.08 | 16865 | 16.8 | 95.4 | 32.9 | 83.6 |
| 10.08–12.70 | 4491 | 4.5 | 99.8 | 15.3 | 98.9 |
| 12.70–16.00 | 181 | 0.2 | 100.0 | 1.1 | 100.0 |
| 16.00–20.20 | 1 | 0.0 | 100.0 | 0.0 | 100.0 |
| 20.20–25.40 | 1 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

100 wt. parts of the above magnetic toner were mixed with 1.0 wt. part of negatively chargeable hydrophobic silica having a chargeability of −250 μc/g and a hydrophobicity of 98% treated with hexamethyldisilazane and dimethylsilicone oil, by means of a Henschel mixer. Then, the resultant mixture was passed through a 100-mesh (Tyler mesh) screen, whereby powder passing through the screen was used as a negatively chargeable one-component developer No. 1. The above-mentioned magnetic toner and magnetic developer had a volume resistivity of $5\times10^{14}$ ohm.cm.

The resultant developer No. 1 had a triboelectric chargeability of −32 μC/g, a BET specific surface area of 2.8 $m^2$g, an aerated bulk density of 0.48 g/$cm^2$, a packed bulk density of 0.90 g/$cm^3$, a true density of 1.65 g/$cm^3$ and a void ($\epsilon_a$) of 71% calculated from the aerated bulk density and true density, as shown in Table 6.

The magnetic developer was subjected to an image formation test by using a commercially available copying machine (trade name: Laser Beam Printer LBP-8AJ1, mfd. by Canon K.K.) having a laminate-type photosensitive drum comprising organic photoconductor (OPC), and comprising a cartridge unit which had been modified by assembling therein the above-mentioned developing device. In the image formation, the surface of the photosensitive drum was primarily charged to −700 V and then the surface was supplied with a laser beam corresponding to an original image comprising a checkered pattern as shown in FIG. 10, thereby to form a digital latent image wherein the exposed portion supplied with the laser beam had a potential of −100 V. The latent image was developed with the magnetic developer according to a reversal development method, while a DC bias of −500 V and an AC bias of 1800 Hz and 1600 V (peak-to-peak value) were applied.

In the above developing operation, the minimum clearance between the developing sleeve of stainless steel and the photosensitive drum was set to 300 microns in the developing position, and the thickness of a developer layer disposed on the sleeve was set to about 100 microns in the developing position under no application of the bias.

As a result, the magnetic developer according to the present invention provided good copied images under any of normal temperature-normal humidity (25° C., 60% RH) condition, high temperature-high humidity (30° C., 90% RH) condition, and low temperature-low humidity (15° C., 10% RH) condition. Further, the thus obtained copied image corresponding to the checkered pattern as shown in FIG. 10 had no image defect.

When successive copying tests of 1,000 sheets were conducted under the respective conditions, the resultant toner image retained an image density of 1.35 or above and were excellent in reproducibility of thin lines.

Figure 14A:
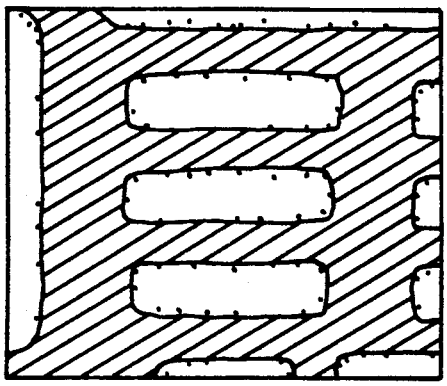
FIGS. 14A, 14B and 14C are views for illustrating scattering ranks represented by the symbols "o", "Δ" and "x", respectively.
Figure 14B:
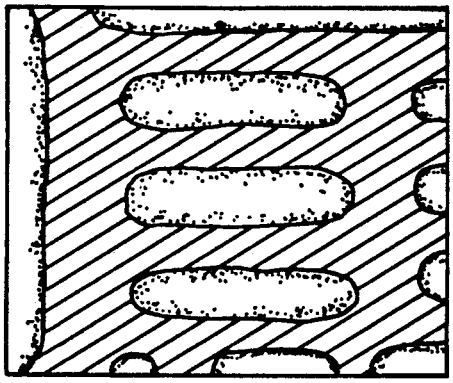
Figure 14C:
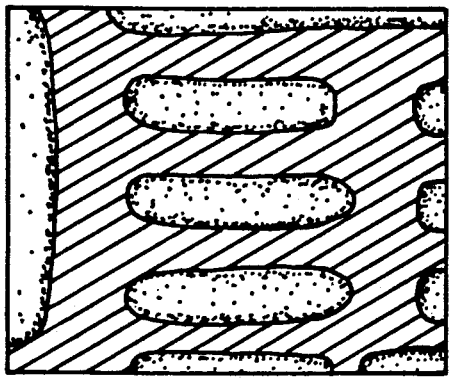

Scattering was evaluated by observing the resultant images having a line width of 50–100 microns with an optical microscope (magnification=100). The resultant image as shown in FIG. 14A was represented by a symbol "o", the resultant image as shown in FIG. 14B as represented by a symbol "Δ", and the resultant image as shown in FIG. 14C was represented by a symbol "x".

The results are shown in Table 7 appearing hereinafter.

EXAMPLE 5

Spherical magnetic particles having a packed bulk density of 0.8 g/$cm^3$, a linseed oil absorption of 20 ml/100 g and a BET specific surface area of 6 $m^2$/g (average particle size=0.29 micron) were subjected to a disintegration treatment thereby to prepare spherical magnetic particles having a packed bulk density of 1.85 g/$cm^3$, a linseed oil absorption of 14 ml/100 g, a BET specific surface area of 5.9 $m^2$/g, and an average particle size of 0.27 microns.

A magnetic toner having a volume-average particle size of 7.7 microns was prepared in the same manner as in Example 4 except for using 90 wt. parts of the above-mentioned spherical magnetic particles.

Some physical properties of the thus obtained magnetic developer are shown in Table 6, and the results of a printer test are shown in Table 7.

COMPARATIVE EXAMPLE 4

A magnetic toner having a volume-average particle size of 12 microns and having a particle size distribution C as shown in Table 5 was prepared in the same manner as in Example 4 except for using 60 wt. % of the above-mentioned spherical magnetite particles and 0.5 part of hydrophobic silica.

Some physical properties of the thus obtained magnetic developer are shown in Table 6, and the results of a printer test are shown in Table 7.

COMPARATIVE EXAMPLE 5

A magnetic toner and a magnetic developer were prepared in the same manner as in Example 4 except for using untreated spherical magnetic particles having a packed bulk density of 0.9 g/cm$^3$, a linseed oil absorption of 25 ml/100 g and a BET specific surface area of 7 m$^2$/g as the magnetic material of the toner. The thus obtained developer was subjected to image formation test in the same manner as in Example 4.

Some physical properties of the thus obtained magnetic developer are shown in Table 6, and the results of a printer test are shown in Table 7.

COMPARATIVE EXAMPLE 6

A magnetic toner and a magnetic developer were prepared in the same manner as in Example 4 except for using non-disintegrated magnetic particles in a cubic crystal system having a packed bulk density of 0.4 g/cm$^3$, a linseed oil absorption of 34 ml/100 g and a BET specific surface area of 7 m$^2$/g as the magnetic material of the toner. The thus obtained developer was subjected to image formation test in the same manner as in Example 4.

Some physical properties of the thus obtained magnetic developer are shown in Table 6, and the results of a printer test are shown in Table 7.

COMPARATIVE EXAMPLE 7

A magnetic developer was prepared in the same manner as in Example 4 except for using 60 wt. parts of the above-mentioned spherical magnetic particles. The resultant developer provided noticeable fog from the initial stage of an image formation test.

Some physical properties of the thus obtained magnetic developer are shown in Table 6, and the results of a printer test are shown in Table 7.

COMPARATIVE EXAMPLE 8

A magnetic developer having an average particle size of 4.5 microns and having a particle size distribution D as shown in Table 5 was prepared in the same manner as in Example 4 except for using 2.0 wt. parts of hydrophobic silica. In the image formation test, the contamination in the machine due to developer scattering was noticeable after image formation of 3,000 sheets.

Some physical properties of the thus obtained magnetic developer are shown in Table 6, and the results of a printer test are shown in Table 7.

TABLE 5

| | Particle size distribution of toner | | | | |
|---|---|---|---|---|---|
| | % by number of particles ≦5 μm | % by volume of particles ≧12.7 μm | % by number of particles 6.35–10.08 μm | Volume-average particle size (μm) | (% by number)/(% by volume) of particles ≦5 μm |
| Example A | 48 | 0 | 20 | 6.5 | 2.5 |
| Example B | 30 | 0.4 | 41 | 7.7 | 3.8 |
| Comp. Example C | 8 | 33 | 48 | 12.0 | 24.0 |
| Comp. Example D | 75 | 0 | 4 | 4.5 | 1.5 |

TABLE 6

| | Magnetic developer | Triboelectric charge amount (μc/g) | BET specific surface area (m$^2$/g) | Aerated bulk density (g/cm$^3$) | Packed bulk density (g/cm$^3$) | True density (g/cm$^3$) | Void % (in aerated state) |
|---|---|---|---|---|---|---|---|
| Ex. 4 | No. 1 | −32 | 2.8 | 0.48 | 0.90 | 1.65 | 71 |
| Ex. 5 | No. 2 | −25 | 2.1 | 0.50 | 0.86 | 1.58 | 68 |
| Comp. Ex. 4 | No. 3 | −19 | 1.4 | 0.54 | 0.77 | 1.40 | 61 |
| Comp. Ex. 5 | No. 4 | −26 | 2.8 | 0.48 | 0.90 | 1.65 | 71 |
| Comp. Ex. 6 | No. 5 | −25 | 2.8 | 0.48 | 0.91 | 1.65 | 71 |
| Comp. Ex. 7 | No. 6 | −36 | 2.7 | 0.48 | 0.78 | 1.42 | 66 |
| Comp. Ex. 8 | No. 7 | −36 | 3.6 | 0.38 | 0.93 | 1.65 | 76 |

TABLE 7

| | Initial stage (at the time of 20 sheets) | | | | | | | at the time of 1000 sheets | | | | | | |
|---|---|---|---|---|---|---|---|---|---|---|---|---|---|---|
| | Image density | | | Dot reproducibility | | | Scat- | Image density | | | Dot reproducibility | | | Scat- |
| | N/N | H/H | L/L | x = 100μ | x = 80μ | x = 50μ | tering | N/N | H/H | L/L | x = 100μ | x = 80μ | x = 50μ | tering |
| Ex. 4 | 1.4 | 1.4 | 1.3 | ○ | ○ | ○ | ○ | 1.4 | 1.4 | 1.4 | ○ | ○ | ○ | ○ |
| Ex. 5 | 1.4 | 1.4 | 1.35 | ○ | ○ | ○ | ○ Δ | 1.4 | 1.4 | 1.4 | ○ | ○ | ○Δ | ○Δ |
| Comp. Ex. 4 | 1.4 | 1.4 | 1.4 | ○ | ○ Δ | x | x | 1.4 | 1.4 | 1.4 | ○ | Δ | x | x |
| Comp. Ex. 5 | 1.3 | 1.2 | 1.2 | ○ | ○ | ○ Δ | ○ Δ | 1.3 | 1.24 | 1.25 | ○ | ○ | ○ Δ | Δ |
| Comp. Ex. 6 | 1.2 | 1.15 | 1.15 | ○ | ○ Δ | ○ | ○ Δ | 1.3 | 1.2 | 1.2 | ○ | Δ | Δ | Δ |
| Comp. Ex. 7 | 1.5 | 1.5 | 1.5 | ○ | ○ | ○ Δ | ○ Δ | 1.2 | 1.5 | 1.0 | ○ | ○ | ○ Δ | Δ |
| Comp. | 1.15 | 1.2 | 1.0 | ○ | ○ | ○ | ○ Δ | 1.35 | 1.35 | 1.3 | ○ | ○ | ○ | ○ Δ |

TABLE 7-continued

| | Initial stage (at the time of 20 sheets) | | | | | | | at the time of 1000 sheets | | | | | | |
|---|---|---|---|---|---|---|---|---|---|---|---|---|---|---|
| | Image density | | | Dot reproducibility | | | Scat- | Image density | | | Dot reproducibility | | | Scat- |
| | N/N | H/H | L/L | x = 100μ | x = 80μ | x = 50μ | tering | N/N | H/H | L/L | x = 100μ | x = 80μ | x = 50μ | tering |
| Ex. 8 | | | | | | | | | | | | | | |

N/N: normal temperature - normal humidity (23.5° C., 60%)
H/H: high temperature - high humidity (32.5° C., 85%)
L/L: low temperature - low humidity (15° C., 10%)

In the above Table, the symbols used in dot reproducibility have the following meanings when 100 black dots were observed in total.

o: Two or less image defects were observed.
oΔ: Three or five image defects were observed.
Δ: Six to ten image defects were observed.
x: Eleven or more image defects were observed.

EXAMPLES 6–10

Respective insulating magnetic toners as shown in Table 8 were prepared in the same manner as in Example 4 except for changing the magnetic material content and classification conditions. The thus obtained insulating magnetic toners were mixed with hydrophobic silica, respectively, thereby to prepare magnetic developers as shown in Table 9.

Successive print out tests were conducted in the same manner as in Example 4 by using the respective magnetic developers. The results are shown in Table 10.

TABLE 8

| | Particle size characteristics of magnetic toner | | | | |
|---|---|---|---|---|---|
| | % by number of particles ≦5 μm | % by volume of particles ≧12.7 μm | % by number of particles 6.35–10.08 μm | Volume-average particle size (μm) | (% by number)/(% by volume) of particles ≦5 μm |
| Example 6 | 20 | 0 | 46 | 7.9 | 4.0 |
| Example 7 | 55 | 0 | 12 | 6.1 | 2.5 |
| Example 8 | 50 | 0 | 38 | 6.4 | 5.0 |
| Example 9 | 33 | 0 | 37 | 6.8 | 5.1 |
| Example 10 | 37 | 0 | 31 | 7.0 | 3.1 |

TABLE 9

| | Hydrophobic silica | | | Physical properties of magnetic developer | | | | | |
|---|---|---|---|---|---|---|---|---|---|
| | External addition amount (wt. %) | Hydrophobicity (%) | Triboelectric charge amount (μc/g) | Triboelectric charge amount (μc/g) | BET specific surface area ($m^2/g$) | Aerated bulk density ($g/cm^3$) | Packed bulk density ($g/cm^3$) | True density ($g/cm^3$) | Void (in aerated state) (%) |
| Ex. 6 | 0.8 | 98 | −250 | −24 | 2.2 | 0.50 | 0.85 | 1.58 | 69 |
| Ex. 7 | 1.4 | 96 | −180 | −33 | 2.9 | 0.46 | 0.95 | 1.72 | 73 |
| Ex. 8 | 1.2 | 98 | −250 | −32 | 2.6 | 0.48 | 0.90 | 1.66 | 71 |
| Ex. 9 | 1.0 | 96 | −220 | −29 | 2.4 | 0.48 | 0.88 | 1.56 | 70 |
| Ex. 10 | 1.0 | 96 | −220 | −29 | 2.4 | 0.50 | 0.87 | 1.56 | 67 |

TABLE 10

| | Initial stage | | | | | | | at the time of 100 sheets | | | | | | |
|---|---|---|---|---|---|---|---|---|---|---|---|---|---|---|
| | Image density | | | Dot reproducibility | | | Scat- | Image density | | | Dot reproducibility | | | Scat- |
| | N/N | H/H | L/L | x = 100μ | x = 80μ | x = 50μ | tering | N/N | H/H | L/L | x = 100μ | x = 80μ | x = 50μ | tering |
| Ex. 6 | 1.4 | 1.4 | 1.3 | o | o | o | oΔ | 1.4 | 1.4 | 1.35 | o | o | o | oΔ |
| Ex. 7 | 1.4 | 1.4 | 1.4 | o | o | o | o | 1.4 | 1.4 | 1.4 | o | o | o | o |
| Ex. 8 | 1.4 | 1.4 | 1.35 | o | o | o | o | 1.45 | 1.4 | 1.4 | o | o | o | o |
| Ex. 9 | 1.4 | 1.4 | 1.4 | o | o | o | o | 1.45 | 1.4 | 1.4 | o | o | o | o |
| Ex. 10 | 1.4 | 1.4 | 1.4 | o | o | o | o | 1.4 | 1.4 | 1.4 | o | o | o | o |

What is claimed is:

1. A magnetic developer for developing electrostatic latent images, comprising hydrophobic silica fine powder and an insulating magnetic toner comprising at least a binder resin and a magnetic material; wherein 0.6 to 1.6 wt. parts of the hydrophobic silica fine powder is mixed with 100 wt. parts of the insulating magnetic toner;

said magnetic developer having a BET specific surface area of 1.8 to 3.5 $m^2/g$, a triboelectric chargeability of −20 to −35 μC/g, an aerated bulk density of 0.40 to 0.52 $g/cm^3$, and a true density of 1.45 to 1.8 $g/cm^3$;

said magnetic material having an average particle size of 0.1 to 0.35 micron and comprising at least 50% by number of spherical magnetic particles whose surfaces substantially comprise curved surfaces;

said insulating magnetic toner containing 70–120 wt. parts of spherical magnetic particles with respect to 100 wt. parts of the binder resin;

said developer containing 17–60% by number of magnetic toner particles having a particle size of no greater than 5 microns, containing 5–50% by number of magnetic toner particles having a particle size of 6.35–10.08 microns, and containing no greater than 2.0% by volume of magnetic toner particles having a particle size of at least 12.7 microns; wherein the magnetic toner has a volume-average particle size of 6–8 microns, and the magnetic toner particles having a particle size of no greater than 5 microns have a particle size distribution satisfying the following formula:

$$N/V = -0.05N + k,$$

wherein N is the percentage by number of magnetic toner particles having a particle size of no greater than 5 micron, V is the percentage by volume of magnetic toner particles having a particle size of no greater than 5 microns, k is a positive number of 4.6 to 6.7, and N is a positive number of 17 to 60.

2. A developer according to claim 1, wherein the hydrophobic silica fine powder has been treated with a silicone oil or a silicone varnish.

3. A developer according to claim 1, wherein the hydrophobic silica fine powder has been treated with a silane coupling agent.

4. A developer according to claim 1, wherein the hydrophobic silica fine powder has been treated with a silane coupling agent and a silicone oil.

5. A developer according to claim 1, wherein the hydrophobic silica fine powder has been treated with a silicone oil having a viscosity of 50–1000 centistoke at 25° C.

6. A developer according to claim 1, wherein the insulating magnetic toner has an electric resistance of at least $10^{14}$ ohm cm, a residual magnetization $\sigma_r$ of 1–5 emu/g, a saturation magnetization $\sigma_s$ of 15–50 emu/g, and a coercive force of 20–100 Öe.

7. A developer according to claim 1, wherein the insulating magnetic toner contains a crosslinked styrene copolymer as a binder resin.

8. A developer according to claim 1, wherein the insulating magnetic toner contains a crosslinked polyester as a binder resin.

9. A developer according to claim 1, wherein the hydrophobic silica fine powder is used in an amount of 0.7–1.4 wt. parts with respect to 100 wt. parts of the insulating magnetic toner.

10. A developer according to claim 1, wherein the hydrophobic silica fine powder has a BET specific surface area of 70–300 $m^2/g$, a triboelectric chargeability of −100 to −300 $\mu C/g$, and a hydrophobicity of at least 90% with respect to ion-exchanged water.

11. A developer according to claim 1, which has a BET specific surface area of 1.9–3.0 $m^2/g$.

12. A developer according to claim 1, which has a residual magnetization $\sigma_r$ of 2–4.5 emu/g, a saturation magnetization $\sigma_s$ of 20–40 emu/g, and a coercive force of 40–100 Öe.

* * * * *

UNITED STATES PATENT AND TRADEMARK OFFICE

CERTIFICATE OF CORRECTION

PATENT NO. : 5,137,796

DATED : August 11, 1992

INVENTOR(S) : TSUYOSHI TAKIGUCHI, ET AL.

It is certified that error appears in the above-identified patent and that said Letters Patent is hereby corrected as shown below:

IN [54] TITLE

"SPHERICAL PARTICLES MAGNETIC" should read --SPHERICAL MAGNETIC PARTICLES--.

COLUMN 1

Line 3, "SPHERICAL PARTICLES MAGNETIC" should read --SPHERICAL MAGNETIC PARTICLES--.

COLUMN 3

Line 29, "has" should read --have--.

COLUMN 4

Line 22, "are" should read --is--.

COLUMN 6

Line 17, "has" should read --have--.
Line 53, "has" should read --have--.

COLUMN 8

Line 12, "has" should read --have--.

COLUMN 10

Line 28, "measurement cap" should read --measurement cup--.
Line 32, "cap the" should read --cap. The--.
Line 54, "is" should read --are--.

UNITED STATES PATENT AND TRADEMARK OFFICE

CERTIFICATE OF CORRECTION

PATENT NO. : 5,137,796

DATED : August 11, 1992

INVENTOR(S) : TSUYOSHI TAKIGUCHI, ET AL.

It is certified that error appears in the above-identified patent and that said Letters Patent is hereby corrected as shown below:

COLUMN 11

Line 8, "are" should read --is--.

COLUMN 13

Line 1, "ununiform" should read --non-uniform--.
Line 10, "ununiform" should read --non-uniform--.
Line 13, "overstep" should read --oversteps--.
Line 27, "decrease" should read --decreases--.

COLUMN 14

Line 7, "such a" should read --having such a--.

COLUMN 16

Line 6, "is" should read --are--.
Line 67, "are" should read --is--.

COLUMN 18

Line 4, "hand, the" should read --hand, if the--.
Line 18, "some" should read --several--.
Line 58, "styreneacrylate" should read --styrene-acrylate--.
Line 60, "styrenea-" should read --styrene-a- --.
Line 63, "styrenebutadiene" should read --styrene-butadiene--.

COLUMN 19

Line 3, "coumaroneindene" should read --coumarone-idene--.
Line 13, "phenomenon," should read --phenomena,--.

UNITED STATES PATENT AND TRADEMARK OFFICE

CERTIFICATE OF CORRECTION

PATENT NO. : 5,137,796

DATED : August 11, 1992

INVENTOR(S) : TSUYOSHI TAKIGUCHI, ET AL.

It is certified that error appears in the above-identified patent and that said Letters Patent is hereby corrected as shown below:

COLUMN 19

Line 61, "styreneisoprene" should read --styrene-isoprene--.

COLUMN 22

Line 8, "a" should be deleted.
Line 31, "then," should read --Then,--.
Line 39, "as" should read --at--.
Line 59, "silica" should read --silicon--.
Line 66, "hydrophobicity-imparting;" should read --hydrophobicity-imparting--.

COLUMN 23

Line 13, "be" should be deleted.
Line 18, "invention. Silicone" should read --invention, silicone--.
Line 54, "another" should read --other--.

COLUMN 24

Line 64, "a" should read --an--.

COLUMN 26

Line 9, "are" should read --is--.

COLUMN 29

Line 17, "be" should be deleted.
Line 18, "presumable" should read --presumably--.
Line 20, "be" should be deleted.

UNITED STATES PATENT AND TRADEMARK OFFICE

CERTIFICATE OF CORRECTION

PATENT NO. : 5,137,796

DATED : August 11, 1992

INVENTOR(S) : TSUYOSHI TAKIGUCHI, ET AL.

It is certified that error appears in the above-identified patent and that said Letters Patent is hereby corrected as shown below:

COLUMN 31

Line 21, "mil," should read --mill,--.
Line 56, "(or packed bulk density)" should be deleted.

COLUMN 34

Line 7, "are" should read --is--.
Line 61, "consider" should read --considerable--.

COLUMN 38

Line 28, "image" should read --images--.
Line 36, "as" should read --was--.

COLUMN 43

Line 7, "5 micron," should read --5 microns,--.

Signed and Sealed this

Seventh Day of December, 1993

Attest:

Bruce Lehman

BRUCE LEHMAN

Attesting Officer

Commissioner of Patents and Trademarks